US005738638A

United States Patent [19]

Henkin et al.

[11] Patent Number: 5,738,638

[45] Date of Patent: *Apr. 14, 1998

[54] PUMP POWERED MASSAGE APPARATUS HAVING A WATER PERMEABLE MEMBRANE

[76] Inventors: Melvyn Lane Henkin, 5011 Donna Ave., Tarzana, Calif. 91356; Jordan Myron Laby, 3038 Bayshore, Ventura, Calif. 93001

[ * ] Notice: The term of this patent shall not extend beyond the expiration date of Pat. No. 5,197,459.

[21] Appl. No.: 200,350

[22] Filed: Feb. 23, 1994

Related U.S. Application Data

[63] Continuation-in-part of Ser. No. 48,356, Apr. 15, 1993, Pat. No. 5,634,888.

[51] Int. Cl.[6] ..... A61H 9/00

[52] U.S. Cl. ..... 601/148; 601/155; 601/158; 601/160; 601/169

[58] Field of Search ..... 601/148, 149, 601/154–158, 160, 161, 165, 169; 239/289, 446, 588, 548; 15/11 D

[56] References Cited

U.S. PATENT DOCUMENTS

| | | | |
|---|---|---|---|
| 1,948,167 | 2/1934 | Cornwell | 601/155 |
| 3,392,920 | 7/1968 | Gagliardo | 239/446 |
| 3,720,204 | 3/1973 | Wojtowicz | 601/160 X |
| 3,722,800 | 3/1973 | Shames et al. | 239/447 |
| 3,902,529 | 9/1975 | Brown | 601/156 X |
| 4,220,145 | 9/1980 | Stamp et al. | 601/169 |
| 4,458,676 | 7/1984 | Pileggi | 601/160 X |
| 4,640,462 | 2/1987 | Stearns, III | 601/160 X |
| 4,709,691 | 12/1987 | Lemons et al. | 601/160 |
| 4,715,071 | 12/1987 | Henkin et al. | 601/169 X |
| 4,731,887 | 3/1988 | Henkin et al. | 601/169 X |
| 4,763,367 | 8/1988 | Henkin et al. | 601/169 X |
| 4,926,510 | 5/1990 | Watkins | 601/148 |
| 5,197,459 | 3/1993 | Henkin et al. | 604/160 |
| 5,230,106 | 7/1993 | Henkin et al. | 601/169 X |

*Primary Examiner*—Danton D. DeMille
*Attorney, Agent, or Firm*—Freilich, Hornbaker & Rosen

[57] ABSTRACT

An apparatus useful in combination with a pump source of recirculated tub water for discharging a water stream for massaging a user's body characterized by a flexible water permeable membrane, preferably of terry cloth, mounted in front of a discharge orifice. In use, water stream discharged from the orifice impacts against the rear face of the membrane while the membrane's front face is held against and massages the user's body. The permeability of the membrane permits water to pass therethrough to wet and lubricate the user's skin. The water permeable membrane spreads the impact area to thus provide a softer more pleasing massage effect while minimizing the amount of unwanted splash. The apparatus may also include a shower outlet for selectively discharging a shower spray.

18 Claims, 19 Drawing Sheets

714
700
204
500
721
708
720
219
28
40
710
202
704
48
722
708
702
706
23
752
750
22
22
708
756
740
748
760

768
770
764
766
23

PUMP POWERED MASSAGE APPARATUS HAVING A WATER PERMEABLE MEMBRANE

RELATED APPLICATIONS

This application is a CIP of application Ser. No. 08/048,356 filed Apr. 15, 1993, now U.S. Pat. No. 5,634,888 whose disclosure is by reference incorporated herein. A related application entitled "Tap Water Powered Massage Apparatus Having A Water Permeable Membrane" is being filed concurrently herewith.

FIELD OF THE INVENTION

This invention relates to apparatus useful in combination with a pump source of recirculated tub water for discharging a water stream for massaging a user's body.

BACKGROUND OF THE INVENTION

Many different devices are known in the art which utilize a water flow to massage a user's body, either by direct impact or by energy transfer through an intermediate member, such as an impermeable membrane. In other devices, the water flow is used to vibrate or rotate a pad or brush which contacts the user's body. Exemplary devices are described in the following patents:

| | | |
|---|---|---|
| 3,902,529 | 4,839,930 | 5,070,552 |
| 4,458,676 | 4,926,510 | 5,187,827 |
| 4,640,462 | 4,930,699 | |
| 4,703,536 | 4,953,240 | |

Still other devices for discharging water streams for massaging a user's body are disclosed in Applicants' following U.S. patents and the references cited therein:

| | | |
|---|---|---|
| 4,679,258 | 4,731,887 | 5,197,459 |
| 4,689,839 | 4,763,367 | 5,230,106 |
| 4,692,950 | 4,813,086 | |
| 4,715,071 | 4,825,854 | |
| 4,726,080 | 4,965,893 | |
| 4,727,605 | 4,982,459 | |

Applicants' aforelisted patents, whose disclosures are by reference incorporated herein, variously disclose both electric pump powered and tap water powered devices for discharging a hydromassage stream through a discharge orifice. Some of the disclosed devices are configured so that the discharge orifice travels along a defined or random path, driven along the path by energy derived from the discharged stream.

Applicant's immediate parent application Ser. No. 08/048,356 describes a hand held apparatus particularly configured to operate from supplied tap water to propel a discharge orifice along a travel path while discharging a water stream of sufficient intensity to impact a user's body to provide a pleasing massage. A preferred embodiment of the apparatus is characterized by a handle housing and a head housing mounted for relative movement with respect to one another for operating an internal mode selector valve. The selector valve directs the supplied tap water to either a hydromassage outlet or a shower spray outlet (e.g., continuous or pulsed spray). The stream discharged from the hydromassage outlet impacts (1) against the rear face of a removable flexible membrane whose front face is held against the user's body, or (2) with the membrane removed, directly against the user's body. The housing includes a protuberance oriented to be held in contact against the user's body to provide a mechanical massage to supplement the hydromassage.

Applicants' U.S. Pat. No. 5,197,459 describes a system utilizing an electric pump to recirculate tub water to a hand held apparatus for discharging a water stream for massaging a user's body. The apparatus includes a hand held housing mounted on the free end of a flexible hose. The pump draws in tub water and supplies it through a nozzle to discharge a water jet into a cavity and create a suction, i.e., negative pressure, therein. The suction is able to draw air and/or tub water (when submerged) into the cavity for mixing with the water jet. Valve means enable the user to selectively open either an air inlet (to cause air entrainment) or a tub water inlet (to cause water entrainment). The housing preferably includes a discharge orifice mounted for movement along a travel path as the water stream is discharged therefrom.

SUMMARY OF THE INVENTION

The present invention is directed to an improved apparatus useful in combination with a water tub and an electric pump for recirculating tub water to the apparatus for discharging a hydromassage stream, either out of or submerged in a water pool in the tub, for massaging a user's body.

Apparatus in accordance with one aspect of the invention is characterized by a flexible water permeable membrane, preferably of terry cloth, mounted in front of a discharge orifice. A water stream discharged from the orifice transfers a portion of its kinetic energy to the membrane for massaging the user's body, while also permitting the stream to pass therethrough to wet and lubricate the user's skin. As contrasted with a stream directly impacting the user's body, the water permeable membrane has the effect of spreading, i.e., defocussing, the impact area to thus provide a softer more pleasing massage effect while minimizing the amount of unwanted splash.

A preferred hand held embodiment includes a housing comprised of a handle portion and a head portion. The hydromassage discharge orifice is mounted in the head portion for travel along a circular path propelled by a reactive force produced by the stream discharged therefrom. As the discharge orifice moves, it causes the stream to impact the rear face of a water permeable membrane tracing a circular path thereon. With the front face of the membrane held against the user's body, the user will experience a pleasing massage.

Apparatus in accordance with the invention is intended for use in water tubs, e.g., bathtubs or spas, having an electric pump which draws water (i.e., "tub water") from a pool in the tub for powering the apparatus. Various embodiments can be configured as hand held or wall mounted units which function to discharge a hydromassage stream either out of, or submerged in, the tub water pool. They can incorporate either a travelling or non-travelling discharge orifice and be operable with or without air and/or water entrainment.

In accordance with a preferred embodiment, a specially configured adapter is provided for coupling a discharge apparatus in accordance with the invention to a conventional spa wall fitting. The adapter includes both air and water passages for coupling to flexible air and water hoses connected to the discharge apparatus. The adapter preferably includes a shut-off valve which is manually operated to open and which automatically closes when the electric pump is inactive.

The water permeable membrane in accordance with the invention serves to minimize unwanted splash when the hand held unit is lifted out of the water, whether inadvertently or to massage, or when the wall mounted unit is above the tub water level. The permeability of the membrane allows water to flow therethrough thus enabling the user's skin to be wetted with comfortably hot water and allowing water to drain from the unit. The membrane is preferably configured for mounting on the housing so that it can be removed if the user desires a "sharper" feeling hydromassage. Removal also enables the membrane to be easily laundered.

In accordance with one feature of a preferred embodiment, the housing is provided with drain holes adjacent the membrane rear face which can be selectively opened or closed to control the outflow of water from behind the membrane rear face.

In accordance with another feature of a preferred embodiment, the hand held unit also includes a shower spray outlet. A user operable selector valve directs a supply water flow to either the shower spray outlet (shower mode) or to the hydromassage discharge orifice (hydromassage mode). The shower spray outlet and discharge orifice are preferably oriented to discharge through different housing faces.

In the operation of a preferred embodiment in the massage mode, tub water is supplied from the pump through a restricted cross section orifice to discharge a high velocity jet flow through a mixing cavity and into a hydromassage passageway which terminates in the aforementioned hydromassage discharge orifice. When operating underwater, tub water floods the cavity, enabling a portion to be entrained by the high velocity jet flow entering the hydromassage passageway, to form a stream of increased mass and reduced velocity for discharge through the discharge orifice against the membrane rear face (or directly against the body when the membrane is removed). When operating out-of-water, the aforementioned drain holes can be closed to cause water reflected from the membrane rear face to accumulate in the cavity to enable the high velocity stream to entrain water. In one alternative preferred embodiment, when in the massage mode, the high velocity stream additionally entrains air.

Wall mounted units in accordance with the invention are particularly useful for massaging a user's neck above the water level in the tub. The wall mounted unit can be permanently mounted in a specially configured tub wall opening or alternatively can comprise a mounting structure adapted to be detachably secured (e.g., via suction cups) to the wall surface. The detachable mounting structure can be configured to releasably accommodate a hand held unit or, alternatively can fixedly incorporate a water discharge head.

DETAILED DESCRIPTION

FIG. 1

Figure 1:
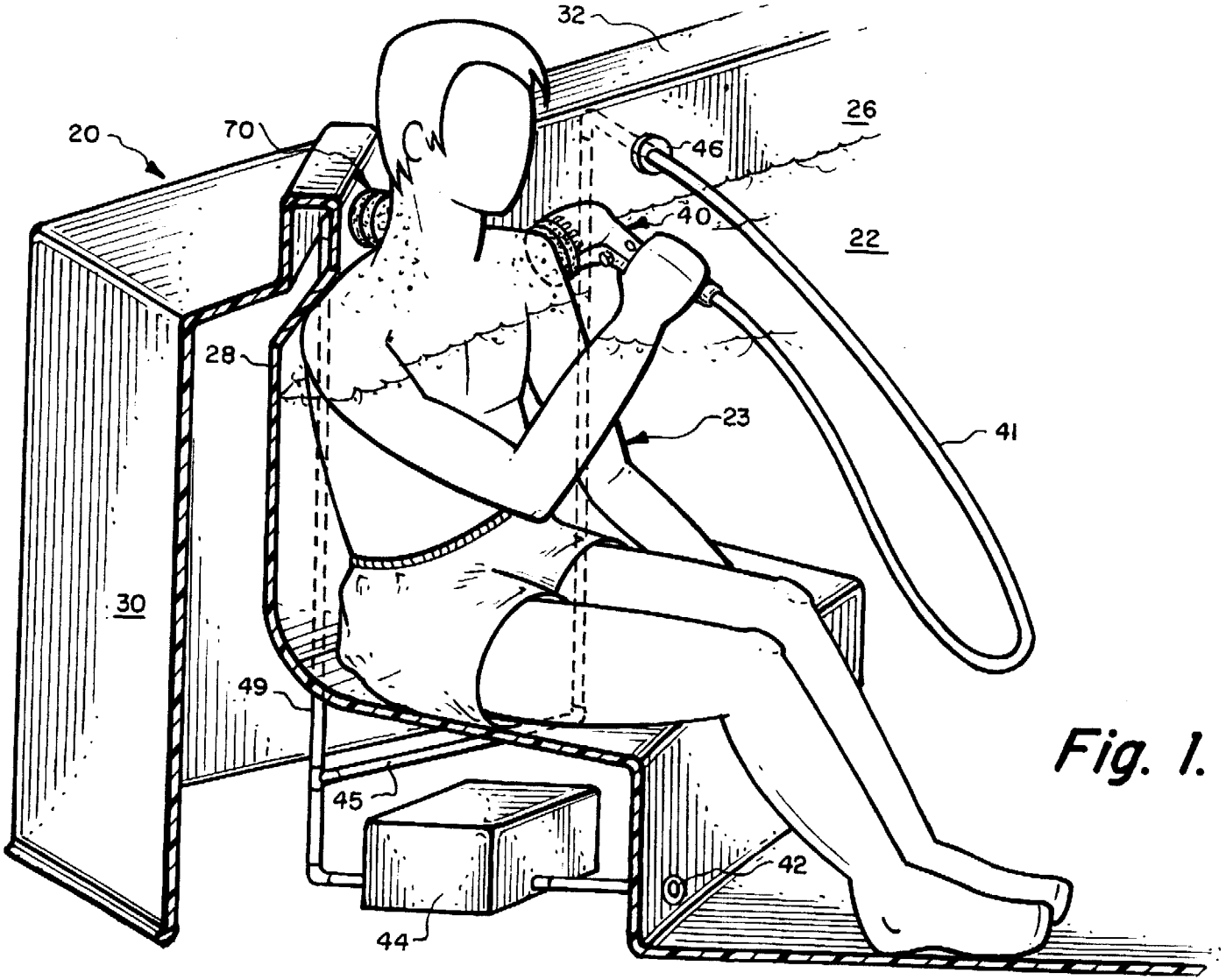
FIG. 1 is an isometric view of a water tub, partially broken away, showing preferred pump powered embodiments of the invention installed therein including a hand held water discharge apparatus 40 and a wall mounted water discharge apparatus 70.
Figure 2:
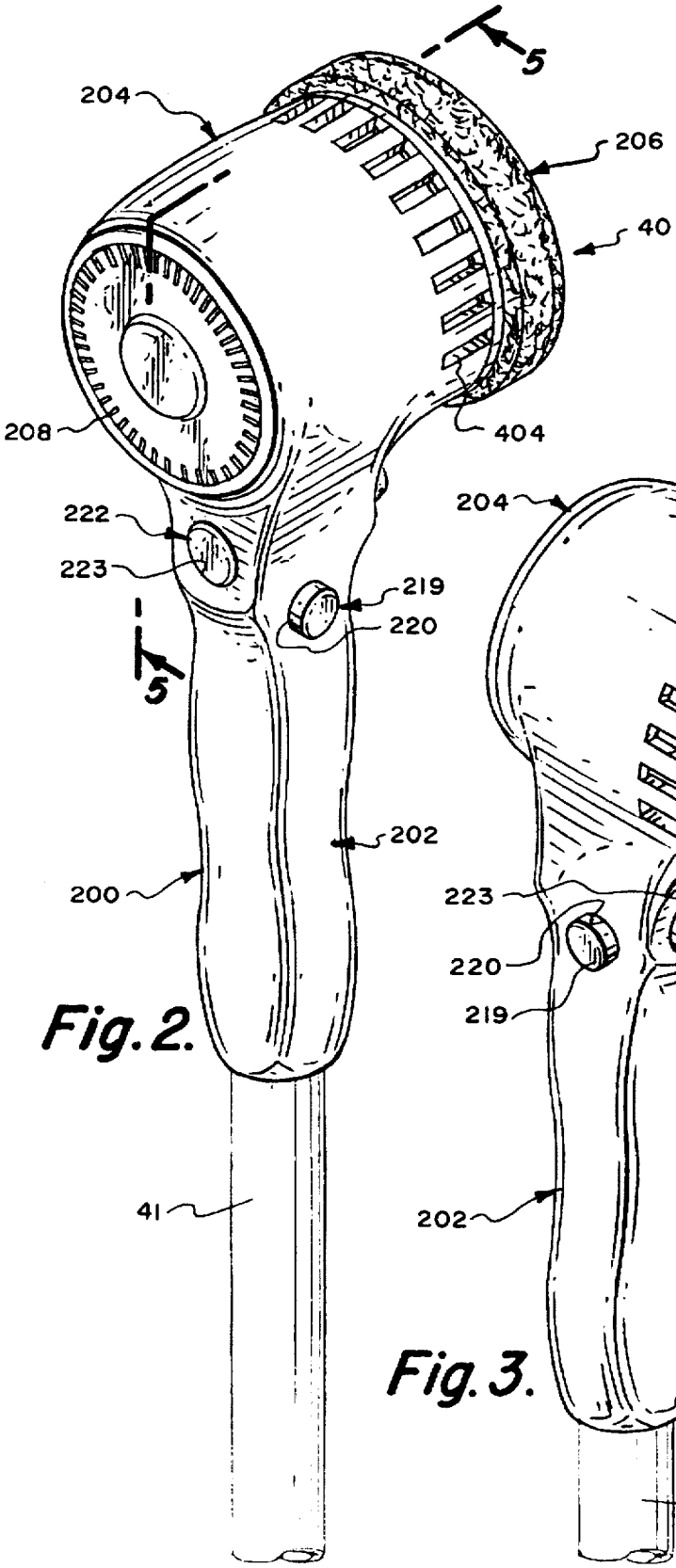
FIG. 2 is a rear isometric view of the hand held embodiment of FIG. 1.
Figure 3:
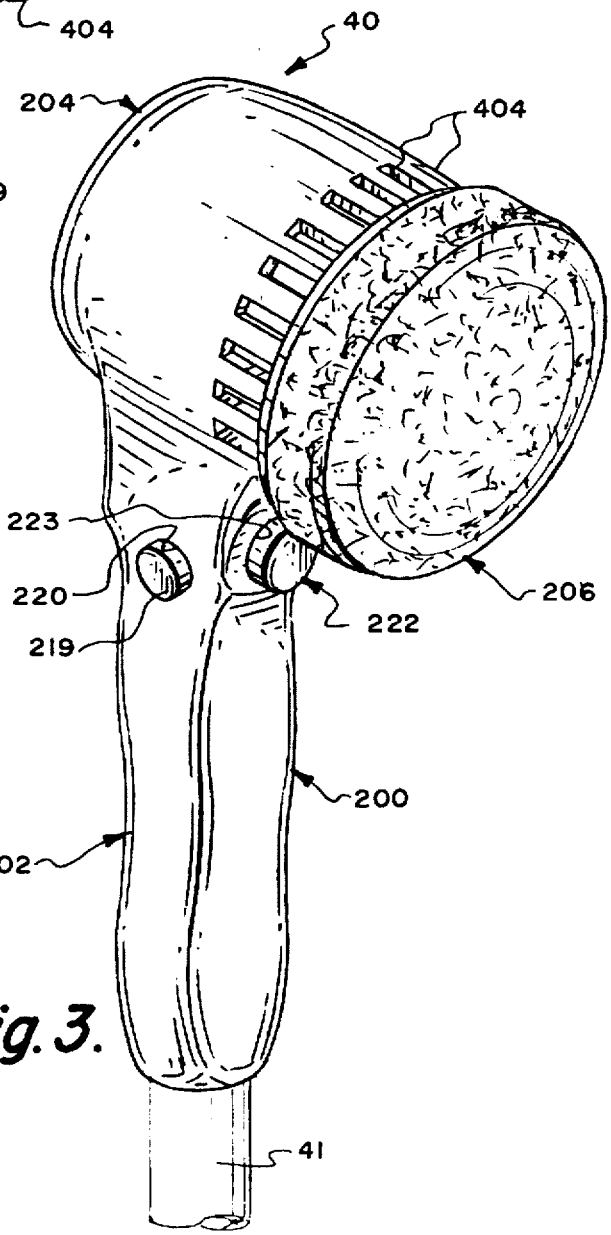
FIG. 3 is a front isometric view of the hand held embodiment of FIG. 2.

Attention is now directed to FIG. 1 which illustrates an exemplary water tub 20 for accommodating a pool of water 22 in which a user 23 can sit. The water tub includes a wall 26 essentially comprised of an inner wall portion 28, an outer wall portion 30, and a deck wall portion 32. A hand held unit 40, comprising a preferred embodiment of the invention, is designed to enable the user to selectively discharge either a shower spray or a hydromassage water stream (useful either out of, or submerged in, water pool 22). The unit 40 is supplied with water via flexible hose 41 drawn from wall inlet 42 by electrically driven pump 44 and transferred via pipe 45 to wall fitting 46 and then to hose 41. The unit 40 can, in accordance with the invention, be operated in either a shower mode or a hydromassage mode, either above or submerged beneath the surface of tub water pool 22.

In addition to supplying water to hand held unit 40, pump 44 supplies water via pipe 49 to water discharge unit 70 which is mounted on inner wall portion 28 preferably at about normal user neck level and above the typical level of water pool 22.

FIGS. 2–10

Attention is now directed to FIGS. 2–10 which illustrate the hand held unit 40 in greater detail. The unit 40 is basically comprised of an integral housing 200 including a handle portion 202 and a head portion 204. As will be explained hereinafter, the handle portion 202 is mounted on the end of supply hose 41 which supplies water to the head portion 204 for discharge either through a hydromassage discharge orifice proximate to the head portion front face 206 or through shower hole openings in a rear face 208.

The handle portion 202 defines an internal elongate water passageway 214 extending from an externally accessible water supply entrance 216 to an internal water supply exit port 218. A first flow control slide valve 219 is mounted for reciprocal movement in channel 220 intersecting passageway 214 to permit a user to variably control water flow therepast. A second selector slide valve 222 is mounted for reciprocal movement in channel 223 oriented perpendicular to channel 220 and downstream therefrom for selectively directing supply water from exit port 218 to either hydromassage entrance port 224 or shower entrance port 226 (FIGS. 4–6).

More particularly, flow control slide valve 219 is comprised of a cylindrical member 230 having a reduced cross-section at gap 232. Circumferential grooves 234, 235 are formed in cylindrical member 230 on opposite sides of gap 232 for respectively receiving O-rings 236, 237. When the member 230 is moved to a position to align gap 232 with passageway 214 (FIGS. 7, 8), supply water flows past valve 219 to supply exit port 218. When member 230 is moved to the right (not shown) from the position shown in FIGS. 7, 8 to place gap 232 out of alignment with passageway 214, supply water flow to exit port 218 ceases except for a preferred low flow rate leakage past valve 219. Total shut off of the supply water flow is preferably accomplished at valves 44, 45 (FIG. 1).

Selector slide valve 222 is similarly comprised of a cylindrical member 238 having a reduced cross-section at gap 240. Circumferential grooves 242, 243 are formed in cylindrical member 238 for respectively receiving O-rings 244, 245. The cylindrical member 238 is dimensioned to slide within channel 223 and end O-rings 246, 247 which seal the ends of the channel. The member 238 is moveable between a first shower mode position (FIG. 6) in which gap 240 communicates exit port 218 with shower supply entrance port 226 and a second hydromassage mode position (FIG. 5) in which gap 240 communicates exit port 218 with hydromassage entrance port 224.

Figure 4:
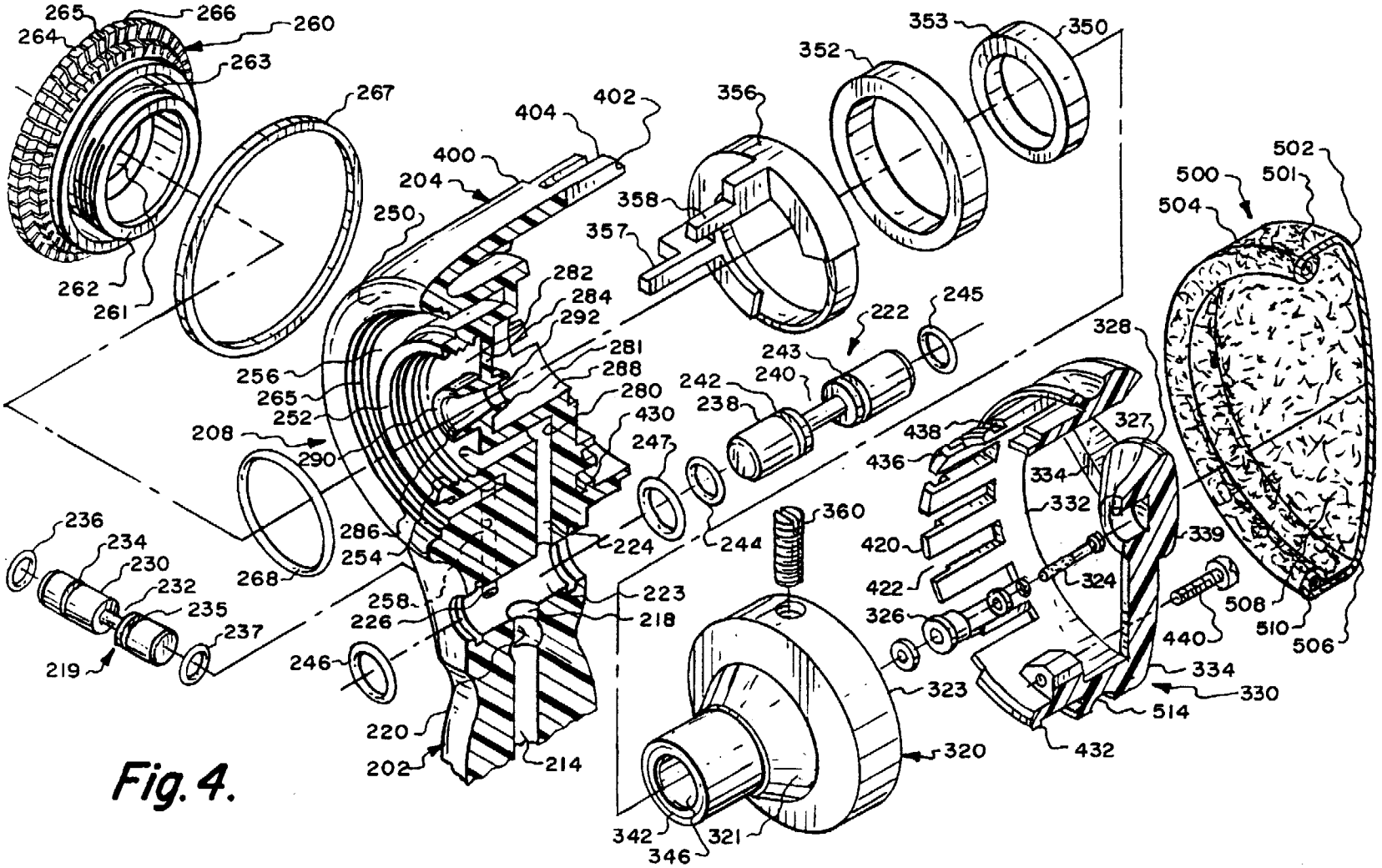
FIG. 4 is an exploded isometric view of the hand held embodiment depicted in FIGS. 2 and 3.
Figure 6:
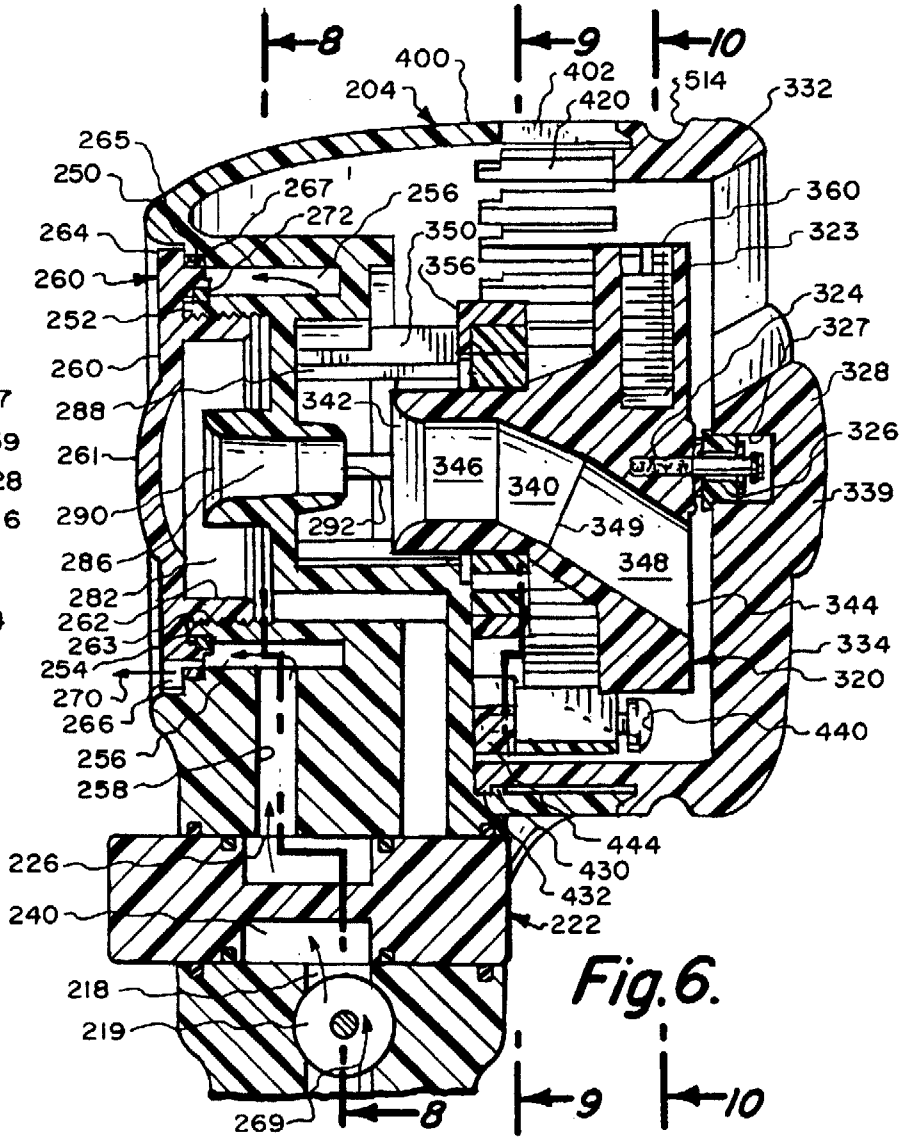
FIG. 6 is a sectional view identical to FIG. 5 except, however, depicting operation in the shower mode.
Figure 5:
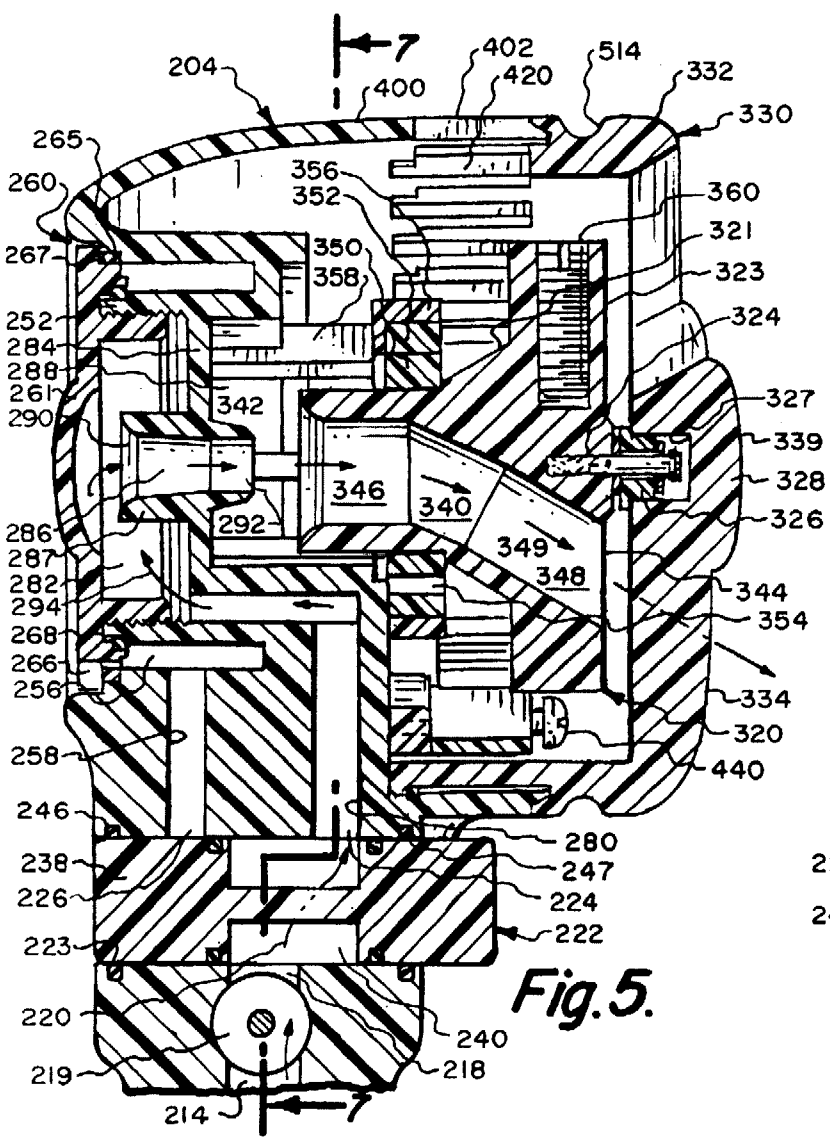
FIG. 5 is a sectional view taken substantially along the plane 5—5 of FIG. 2 depicting operation in the hydromassage mode.
Figure 8:
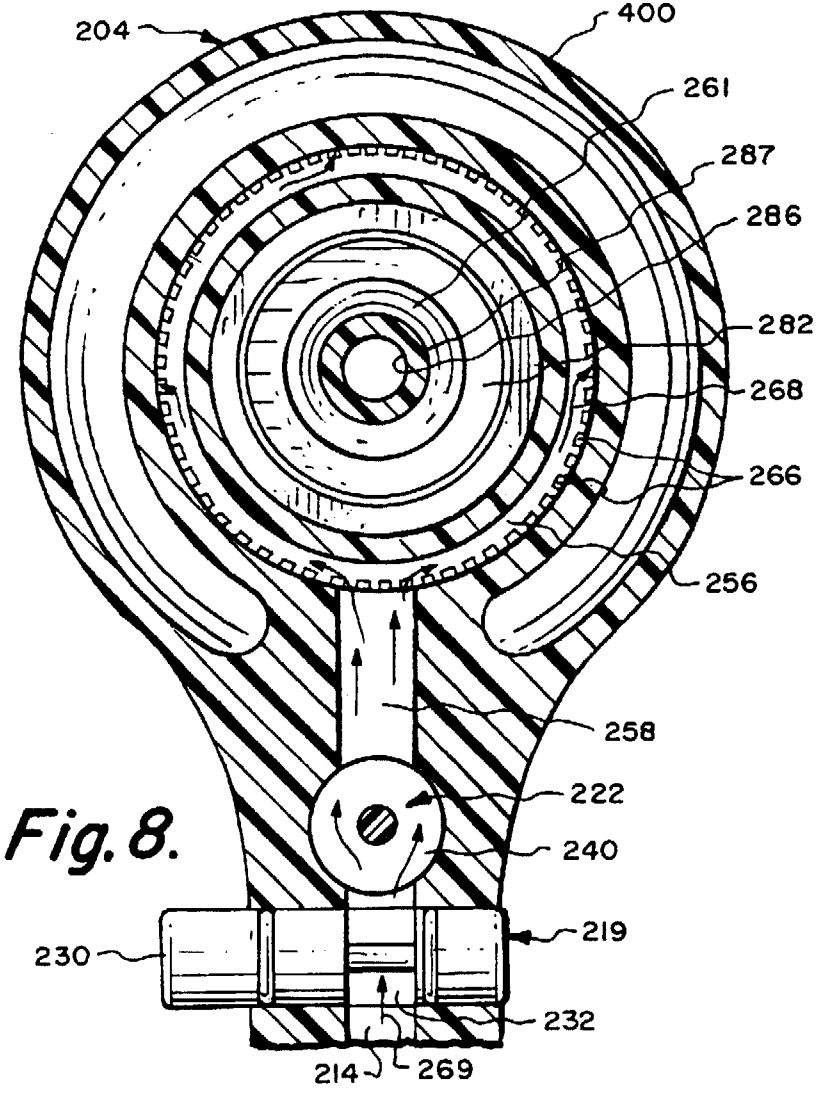
FIG. 8 is a sectional view taken substantially along the plane 8—8 of FIG. 6.
Figure 7:
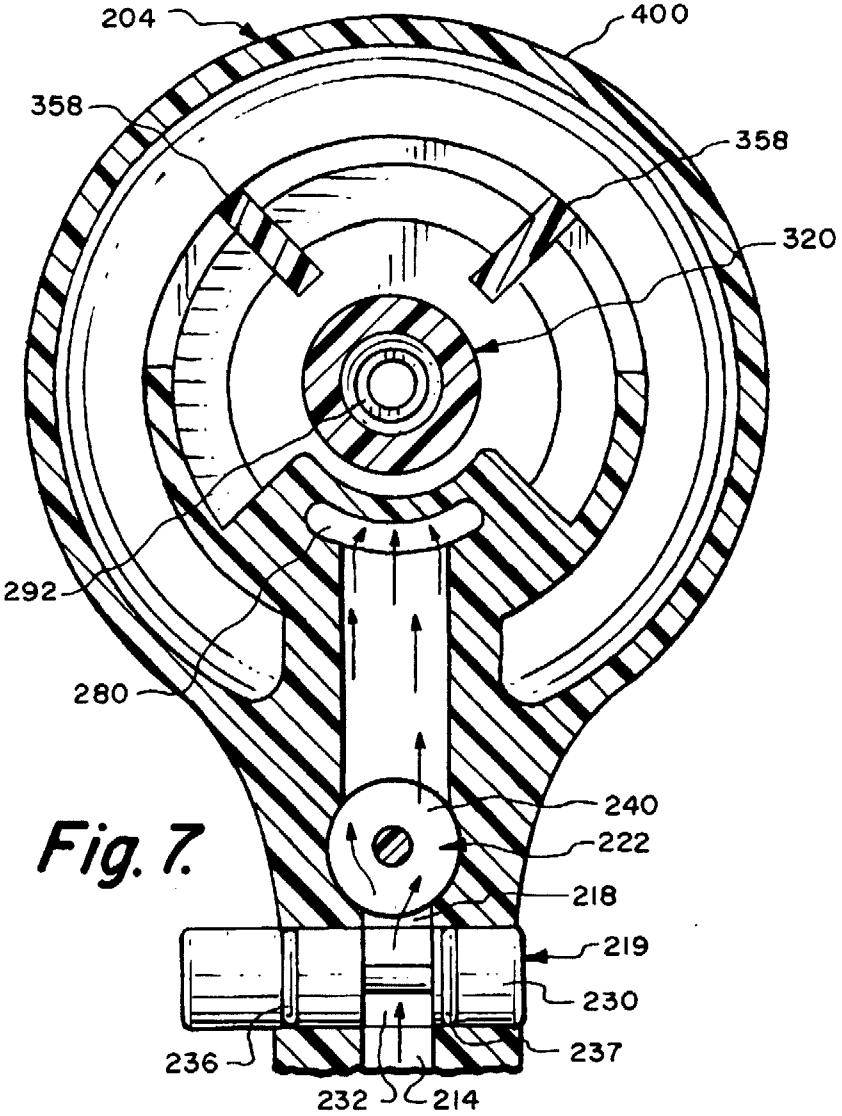
FIG. 7 is a sectional view taken substantially along the plane 7—7 of FIG. 5.
Figure 10:
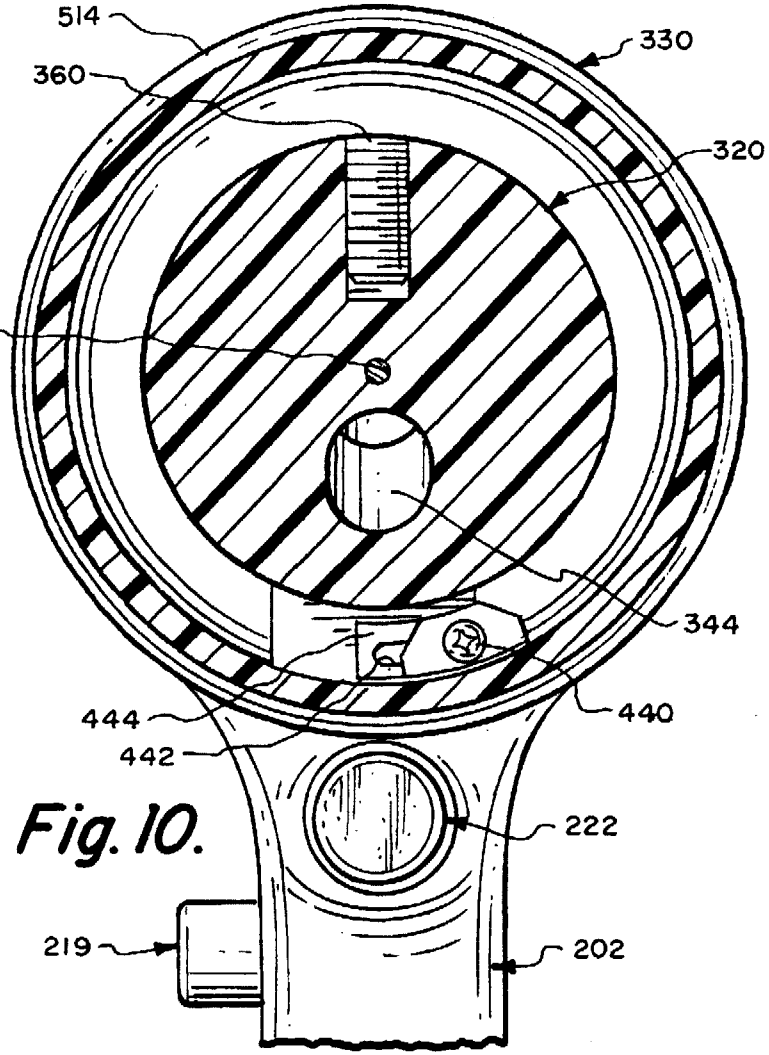
FIG. 10 is a sectional view taken substantially along the plane 10—10 of FIG. 6.

Initially considering operation in the shower mode, attention is directed primarily to FIGS. 4, 6 and 8. The head portion rear face 208 is framed by a peripheral lip 250 which extends around an axially extending concentric nipple 252, internally threaded at 254. An annular shower water manifold 256 is defined between lip 250 and nipple 252. Passageway 258 couples shower entrance port 226 to manifold 256.

A shower outlet ring 260 is provided having a closed face 261 (FIG. 6) and a cylindrical boss 262 extending axially therefrom, externally threaded at 263, for coupling to nipple 252. The ring 260 defines an outer circumferential surface 264 which steps down to an inner circumferential surface 265. A plurality of radial slits 266 extend into circumferential surfaces 264, 265. A gasket ring 267 fits around inner circumferential surface 265 to direct water flow from manifold 256 (FIG. 6) through radial slits 266 which comprise shower spray outlets. An O-ring 268 is preferably mounted around the annular manifold 256 to prevent leakage therefrom.

Thus, in use in the shower mode, supply water 269 (FIG. 6) will flow past flow control valve 219 and selector valve 222 into shower entrance port 226, and then via passageway 258 into manifold 256 from which a shower stream 270 will issue from each radial slit 266.

Attention is now primarily directed to FIGS. 4, 5, 7, 9 and 10 which depict views of the hand held unit 40 which best illustrate its operation in the hydromassage mode. For operation in the hydromassage mode, the selector valve 222 must be in the position depicted in FIG. 5 so as to communicate supply exit port 218 with hydromassage entrance port 224. A passageway 280 extends from entrance port 224 to a chamber 282 substantially sealed between the shower outlet ring closed face 261 and internal wall 284 extending across nipple 252. The only outlet from chamber 282 is defined by nozzle passageway 286 formed in boss 287 extending axially through wall 284 to cavity 288. The nozzle passageway 286 converges from a wider entrance 290 to an exit orifice 292 having a reduced cross section to thus increase the velocity of water flow 294 between chamber 282 and cavity 288.

Mounted for rotation within the head housing 204 is a hydromassage member 320 comprising a funnel shaped block 321 having a front face 323 secured to axial pin 324.

Pin 324 is in turn mounted for rotation in bearing 326 accommodated in recess 327 in hub 328 of frame 330 defined by an outer ring 332 and multiple legs 334. Legs 334 extend radially from the hub 328 to the outer ring 332 which essentially defines the aforementioned head portion front face. The hub 328 comprises a protuberance defining a front surface projecting forwardly of legs 334. Front surface 339 is intended to be held against a user's body for mechanically massaging.

A hydromassage passageway 340 is defined in the hydromassage member 320 extending between an entrance orifice 342, and a discharge orifice 344 formed in front 25 face 323 of member 320. The passageway 340 includes a first elongate portion 346 oriented at a first acute angle relative to the rotation axis defined by pin 324 and a second elongate portion 348 which deviates at 349 by an acute angle relative to portion 346. Note that the discharge orifice 344 defined by passageway portion 348 is radially displaced from the pin 324. Thus, water flowing into entrance orifice 342 will traverse passageway portions 346 and 348 prior to exiting at discharge orifice 344. The directional change imposed on the water flow through passages 346 and 348 creates a tangentially directed moment arm to thus rotate member 320 about the rotation axis defined by pin 324. Note that the member 320 carries a bearing ring 350 which rotates within a fixed outer bearing ring 352. The inner bearing ring 350 is preferably eccentrically configured to define a high point 353 oriented opposite to the discharge orifice 344. This creates a space 354 (FIG. 9) between the bearing rings in which a small amount of water can be drawn into the cavity 288 for lubricating the adjacent bearing ring surfaces. Bearing ring 352 is accommodated in a cup-shaped frame member 356 having rearwardly projecting legs 357, 358 which axially locate frame member 356.

The member 320 preferably carries an eccentrically mounted weight 360 proximate to its peripheral surface preferably located diametrically opposite to discharge orifice 344. The purpose of this weight is to enhance the mechanical massaging afforded by the protuberance 328 when it is held against the user's skin and the unit is operated in the hydromassage mode.

The cavity 288 is partially defined and enveloped by the annular outer wall 400 of housing head portion 204. The front annular edge of wall 400 is defined by forwardly projecting fingers 402 spaced by intermediate slots or ports 404. The ports 404 provide a path from outside the housing 200 to the internal cavity 288.

The frame 330 is configured for mounting on the housing portion 204 in cooperative relationship with the forwardly projecting fingers 402. More particularly, the frame outer ring 332 has a plurality of fingers 420 which extend rearwardly and are spaced by slots 422. When the frame 330 is mounted adjacent the front edge of wall 400, its rearwardly extending fingers 420 lie radially inward of fingers 402 projecting forwardly from wall 400. The frame 330, as will be discussed, is mounted for limited rotation relative to the wall 400 between a first position in which the cavity 288 is essentially closed and a second position in which the cavity 288 is open to the outside. More particularly in the first position, the frame 330 is rotated to align the rearwardly extending fingers 420 with the slots 404 to thus close the cavity 288. In the second position (FIG. 9), fingers 420 are aligned with fingers 402 thus aligning slots 404 and 422 and opening the path from the cavity 288 to the outside.

Figure 9:
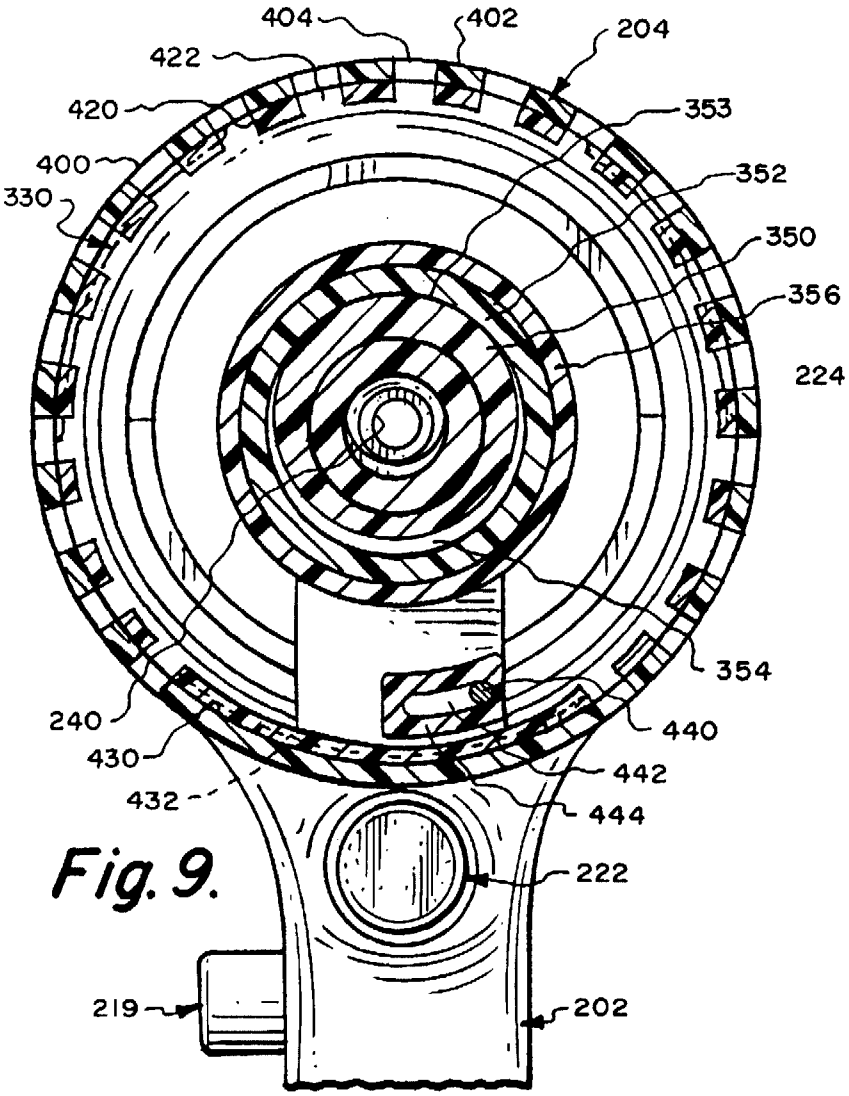
FIG. 9 is a sectional view taken substantially along the plane 9—9 of FIG. 6.

In order to mount the frame 330 on the head portion 204 for rotation between the aforementioned first and second positions, a bayonet type interconnection is preferably provided. Thus, the head portion 204 is provided with at least one radially inwardly extending flange 430 extending partially around the housing wall 400. The rear edge of frame outer ring 332 is provided with a terminal hook 432 configured to rotate behind the flange 430 to secure the frame 330 against axial movement relative to the head portion wall 400. In addition to the hook 432, terminal hooks 436 are provided on selected fingers 420 to define a groove 438 to accommodate an additional appropriately positioned flange section (not shown) projecting inwardly from the wall 400. Rotation of frame 330 relative to housing wall 400 is limited by bolt 440 which is carried by frame 330 and projects into a short arcuate slot 442 formed in block 444 (FIG. 9).

In accordance with a significant aspect of the invention, a membrane structure 500 formed primarily of a flexible water permeable material 501, e.g., terry cloth, is provided. The membrane 500, as depicted in FIG. 4, is preferably cup shaped defining a front panel 502 and a rearwardly extending annular wall 504. The front panel 502 defines front and rear faces 506 and 508. An annular elastic member 510 is preferably secured to the rear edge of the wall 504 and dimensioned to be received in an annular groove 514 defined in the exterior surface of frame outer ring 332. The membrane front panel 502 thus extends across and is substantially contiguous with the head portion front face 206 defined by frame outer ring 332. The front surface 339 of the protuberance 328 preferably bears against the rear face 508 of the membrane front panel 502.

As the hydromassage member 320 rotates in response to the discharge of the water stream from discharge orifice 344, the stream will produce a reaction force tending to move the protuberance 328 in a direction opposite to the direction of discharge. By applying firm, but gentle, pressure of the protuberance surface 339 against the user's skin through the membrane material 501, the protuberance will mechanically massage the user while the eccentric weight 360 exaggerates this motion to enhance mechanical massaging. This mechanical massaging effect supplements the hydromassage effect produced by the stream emanating from the discharge orifice 344 which massages the user through the membrane as it moves along its circular travel path around the rotation axis defined by pin 324.

The unit 40 can be used in the hydromassage mode either underwater or out of the water and either with or without the membrane structure 500 in place. When used underwater, the cavity 288 will typically be flooded and the high velocity flow from orifice 292 into hydromassage entrance 342 will entrain water from the cavity to form a flow of increased mass and reduced velocity to discharge from discharge orifice 344. With the membrane structure 500 in place, the membrane material will spread or defocus the impact to provide a soft pleasing massage effect. If the membrane is removed, the user will experience a sharper, more focussed impact. When the unit is used out of the water, the housing ports 404 may be closed to accumulate in the cavity 288 water reflected from the rear face 508 of the membrane. This accumulated water provides water for entrainment by the high velocity flow entering the hydromassage entrance orifice 342, thus enabling the unit to discharge a soft pleasing massage effect even when used out of the water. The permeable membrane, in addition to softening the discharge to enhance the hydromassage effect, also minimizes unwanted splash.

FIGS. 11–14

Figure 15:
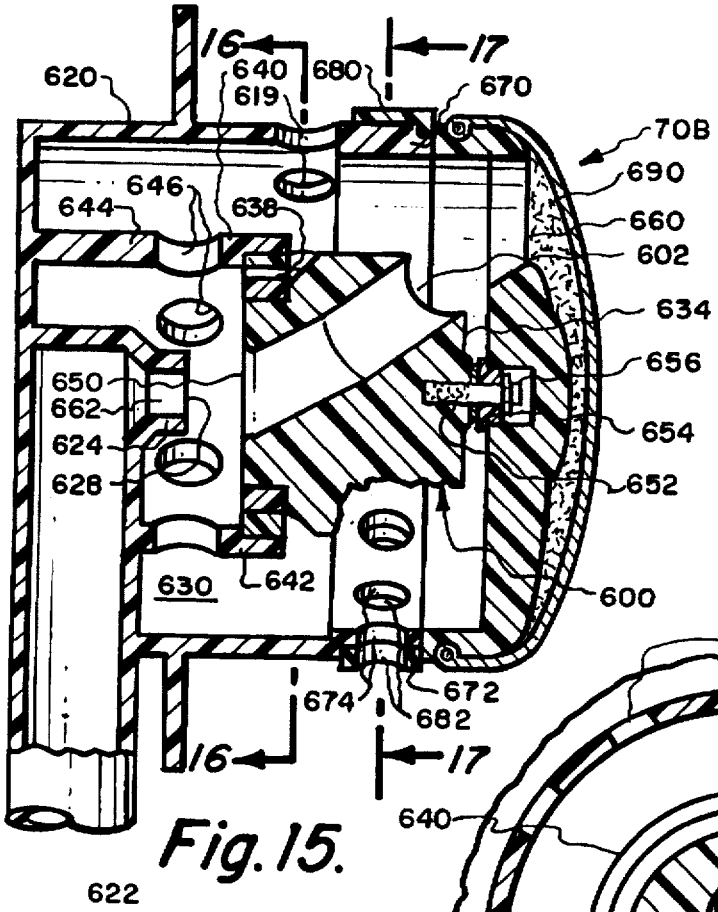
FIG. 15 is a vertical sectional view through an alternative wall mounted discharge apparatus having a travelling discharge orifice.
Figure 16:
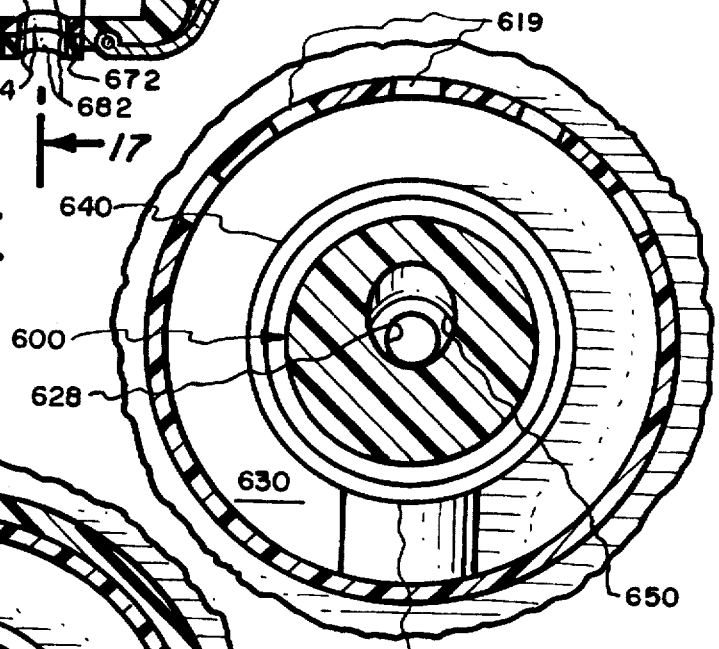
FIG. 16 is a sectional view taken substantially along the plane 16—16 of FIG. 15.
Figure 17:
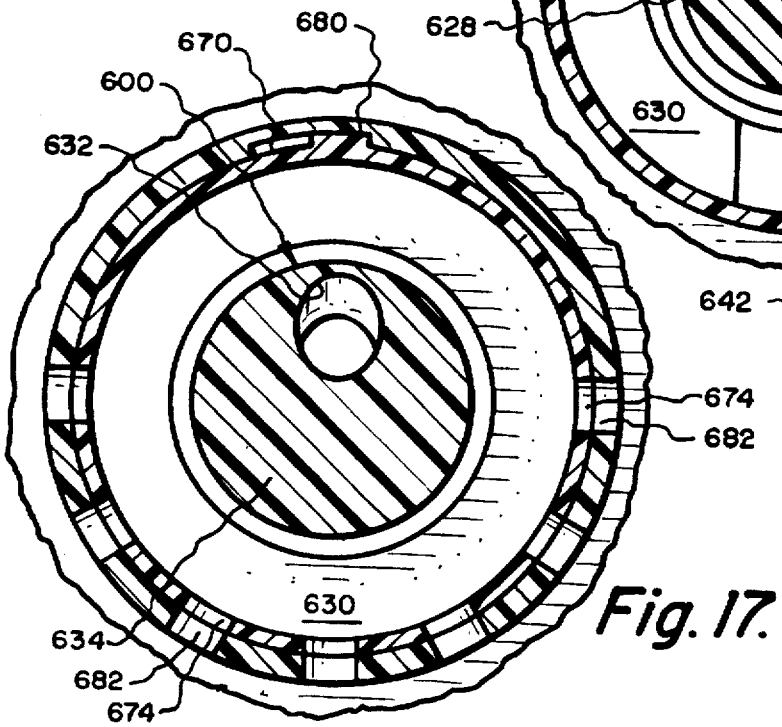
FIG. 17 is a sectional view taken substantially along the plane 17—17 of FIG. 15.

A first embodiment 70A of wall mount unit 70 having a non-travelling discharge orifice is shown in FIGS. 11–14. A second embodiment 70B of wall mount unit 70 having a travelling discharge orifice is shown in FIGS. 15–17.

The unit 70A is comprised of a substantially cylindrical housing 522 having a sidewall 524, a rear wall 526 and an open front face 528. A radial flange 530 extends outwardly from the sidewall 524 for engaging the interior surface of bathtub inner wall portion 28. The portion of the housing 522 projecting forwardly from the flange 530 toward the open face 528 extends through an opening in the wall portion 28 to enable the user 23 to locate his neck and upper back proximate to the housing front face 528, as will be more specifically discussed hereinafter.

The housing 522 is configured with a pipe section 534 intended to be coupled to pipe 49, as shown in FIG. 1. The pipe section 534 enters the housing 522 and at its upper end communicates with passageway 536 formed in boss 537. The passageway 536 converges from a relatively wide entrance 540 to a reduced cross section exit orifice 542 which opens into cavity 546 formed interiorally of housing 522. A short conduit 550 defining an entrance throat 552 and a straight wall passageway 554 is axially aligned with exit orifice 542. The conduit 550 is supported by radial arms 556 extending inwardly from the housing sidewall 524. The conduit straight wall portion 554 terminates at its forward end at discharge orifice 560, proximate to the open front face 528 of housing 522.

Figure 11:
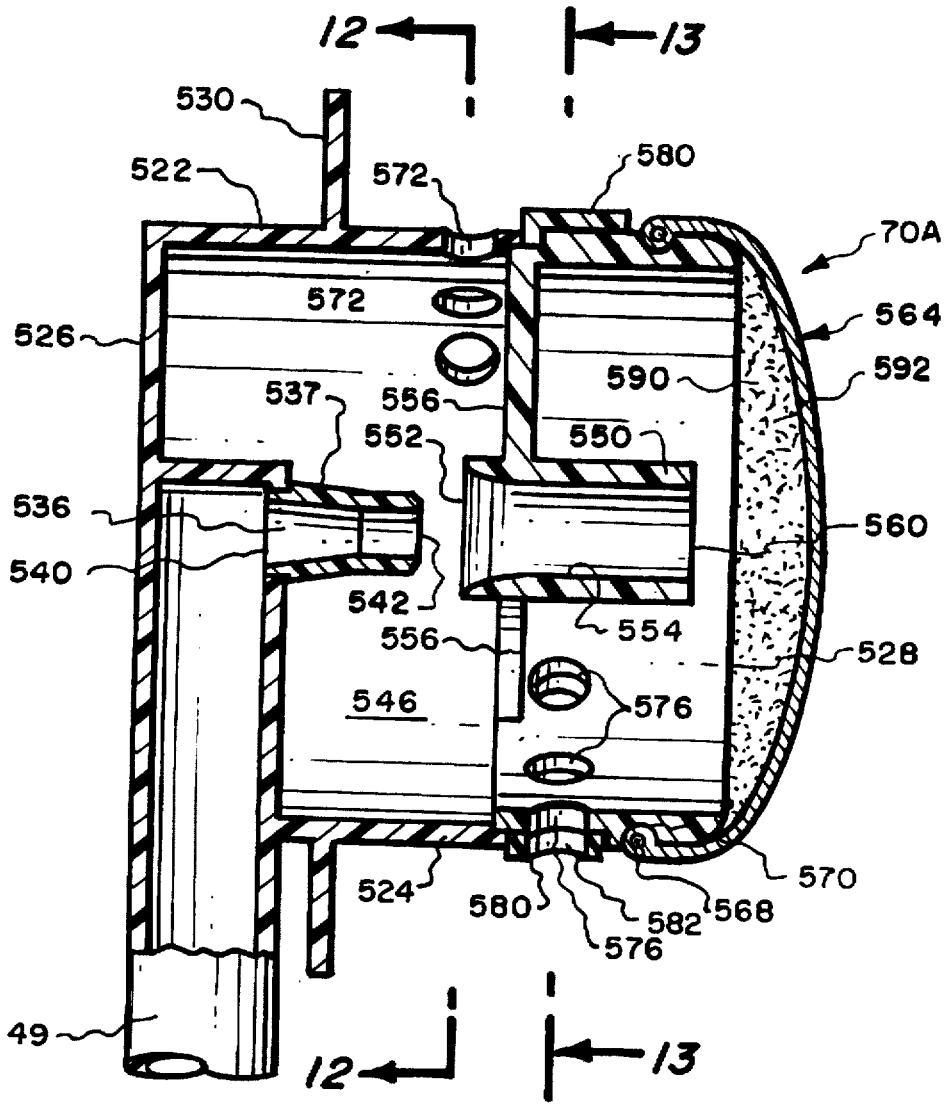
FIG. 11 is a vertical sectional view through the wall mounted discharge apparatus 70 of FIG. 1 having a non-travelling discharge orifice.

As is best shown in FIG. 11, a water permeable membrane structure 564, essentially identical to the aforementioned membrane structure 500, is mounted across the front face 528 of housing 522. The structure carries an annular elastic member 568 which extends into annular groove 570 defined in the exterior surface of housing sidewall 524.

Figure 12:
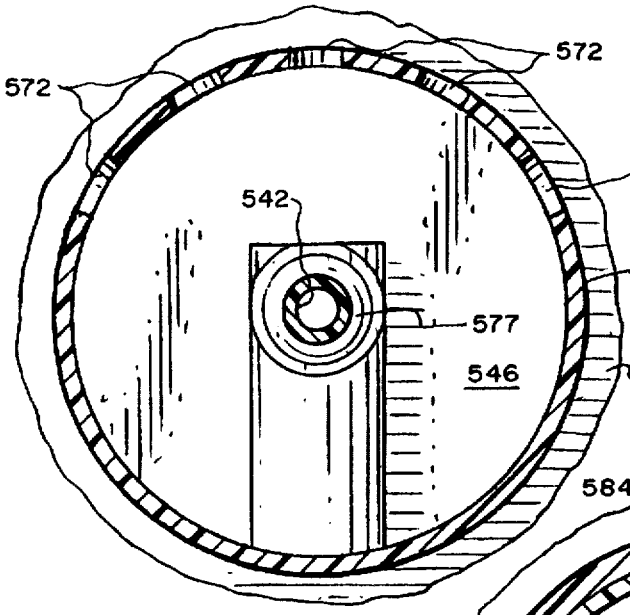
FIG. 12 is a sectional view taken substantially along the plane 12—12 of FIG. 11.
Figure 13:
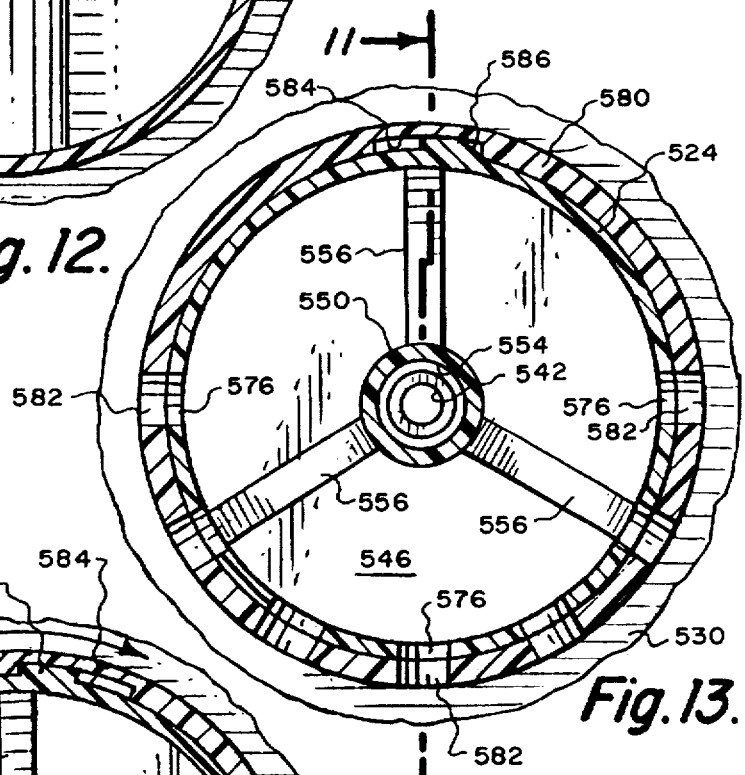
FIG. 13 is a sectional view taken substantially along the plane 13—13 of FIG. 11 showing the apparatus drain holes open for hydromassage operation without water entrainment.
Figure 14:
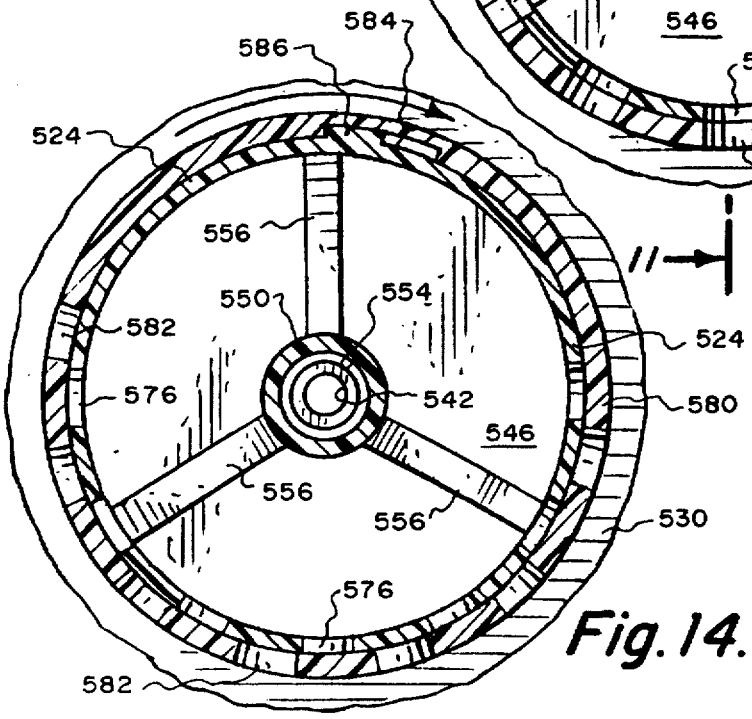
FIG. 14 is a sectional view similar to FIG. 13 showing the drain holes closed for hydromassage operation with water entrainment.

As is best shown in FIG. 12, at least one overflow hole 572 is formed in the housing sidewall 524 vertically above the axis of exit orifice 542. Note in FIG. 12 that the overflow holes 572 are preferably located between a 10 o'clock and 2 o'clock position. Also note the provision of drain holes 576 in the lower portion of housing wall 524 vertically beneath the exit orifice 542. As shown in FIG. 13, the drain holes 576 are located between the 3 o'clock and 9 o'clock positions.

A collar 580 is mounted for limited rotation around the exterior surface of housing wall 524. The collar is perforated to define a series of openings 582. When the collar 580 is rotated to the position shown in FIG. 13, the openings 582 align with the drain holes 576 in the housing wall 524. On the other hand, when the collar 580 is rotated to the position depicted in FIG. 14, the openings 582 move out of alignment thus closing the drain holes 576. The rotation of the collar 580 on the housing wall 524 is limited by a short annular slot 584 on the collar which receives a fixed tab 586 projecting radially outwardly from housing wall 524.

In normal operation, supply water from pipe section 534 will enter passageway 536 to produce a high velocity discharge out of reduced cross section exit orifice 542. This high velocity discharge will enter the passageway through conduit 550 emerging from discharge orifice 560 for impact against the rear face 590 of membrane material 592. With the collar 580 in the position shown in FIG. 15, i.e., with the drain holes closed, water reflected from the membrane rear face 590 will accumulate in cavity 546. When the level of this accumulated water rises above the axis of the exit orifice 542 and conduit 550, the high velocity discharge from orifice 542 will entrain water as it enters the conduit 550, thus providing a flow of increased mass and lower velocity at the discharge orifice 560 for impacting against the membrane 592. The overflow holes 572 provide an outlet for the water accumulated in 546 thus preventing the water from impeding the flow out of exit orifice 542. By rotating the collar 580 to the position shown in FIG. 13, the drain holes 576 are opened to prevent water accumulation in the cavity 546, thus avoiding water entrainment and producing a sharper, less diffuse impact against the membrane 592.

In use, the user 23 will position his neck against the outer front face of the membrane 592. The water stream discharged from discharge orifice 560 will impact against the membrane 592 and transfer energy therethrough to massage the user while also permitting water flow therepast to wet the user with comfortably hot tap water.

FIGS. 15–17

Attention is now directed to FIGS. 15–17 which illustrate the wall mount unit 70B. As will be seen, unit 70B is similar to aforedescribed unit 70A except that it includes a rotatable hydromassage member 600 which enables its discharge orifice 602 to travel along a circular path. More particularly, the unit 70B is comprised of a substantially cylindrical housing 620 defining a pipe inlet section 622 terminating in boss 624 defining a converging passageway 626 terminating in reduced cross section exit orifice 628. The housing 620 internally defines a cavity 630 so that water accumulated in the cavity above the level of orifice 628 will be entrained by the high velocity discharge from orifice 628, prior to entering the hydromassage member passageway 632. Hydromassage member 600 is mounted for rotation in a manner substantially identical to member 320 previously discussed in the embodiment of FIGS. 4–10. More specifically, member 600 carries an inner bearing ring 638 proximate to its rear face which rotates within a fixed bearing ring 640. Bearing ring 640 defines holes 646 which communicate the volume within the housing 620 outside of the ring 640, with the volume within the ring 640 which forms the aforementioned cavity 630. Water accumulating in the cavity vertically above the exit orifice 628 will be entrained by the high velocity discharge at the entrance 650 to hydromassage passageway 632 which terminates at the aforementioned travelling discharge orifice 602.

The hydromassage member 600 is supported at its forward end by axial pin 652 mounted for rotation in bearing 654 held in recess 656 of hub 658 of frame 660. The frame 660 includes a rearwardly projecting skirt portion 670 which interlocks with and is secured to the housing 620 at 672. The skirt portion 670 of the frame 660 is provided with drain holes 674, analogous to the drain holes 576 discussed in connection with the embodiment of FIGS. 11–14. The skirt portion 670 carries a rotatable collar 680 which defines openings 682 which can be selectively aligned with the drain hole 674. Thus, the collar 680 can be manually operated identically to the collar 580 discussed in connection with the embodiment of FIGS. 11–14 to selectively open or close drain holes 674 to thereby either drain or accumulate water in the cavity 630. As previously mentioned, when a sufficient amount of water accumulates to rise above the exit orifice 628, the high velocity flow therefrom will entrain water from the cavity to thereby provide a discharge flow from discharge orifice 602 of lower velocity and increased mass. This discharge flow will impact against the rear face of membrane 690 to create a pleasing massage effect, as aforedescribed, with the front face of the membrane held against the user's body. Holes 619 are provided in the housing sidewall to permit overflow from the cavity 630.

FIGS. 18–20

Figure 18:
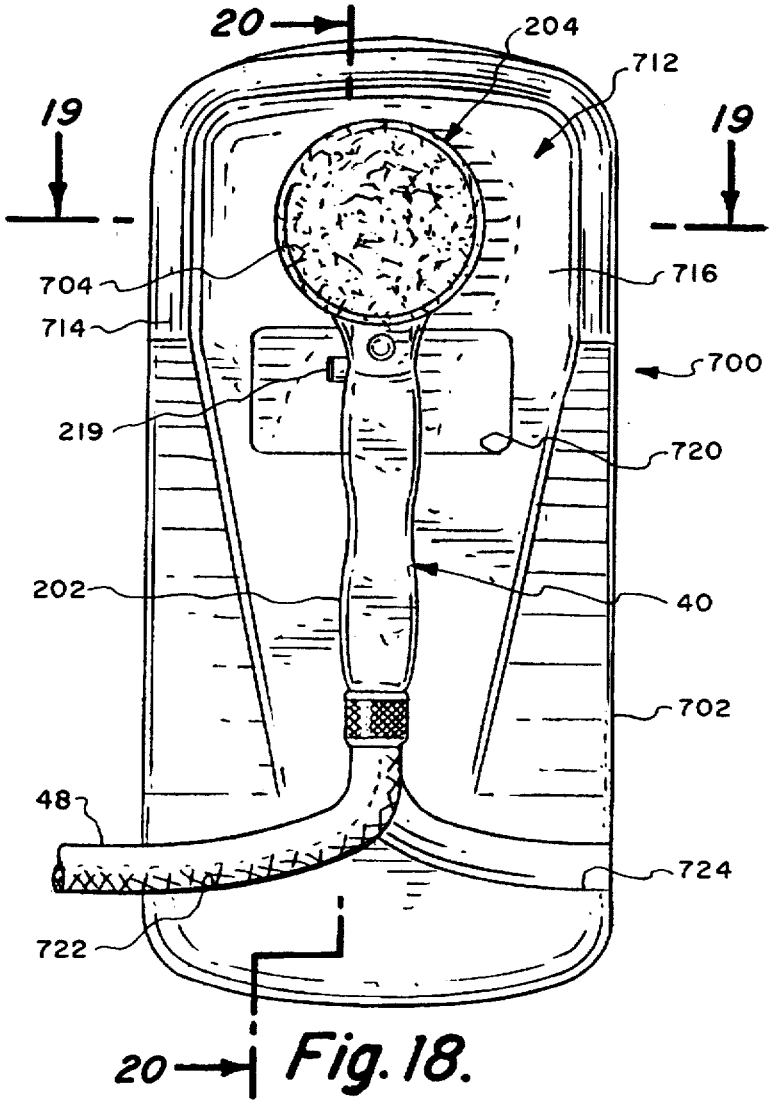
FIG. 18 is a front elevational view of a mounting structure adapted to be detachably secured to a bathtub wall for releasably accommodating the hand held water discharge apparatus of FIG. 1.
Figure 19:
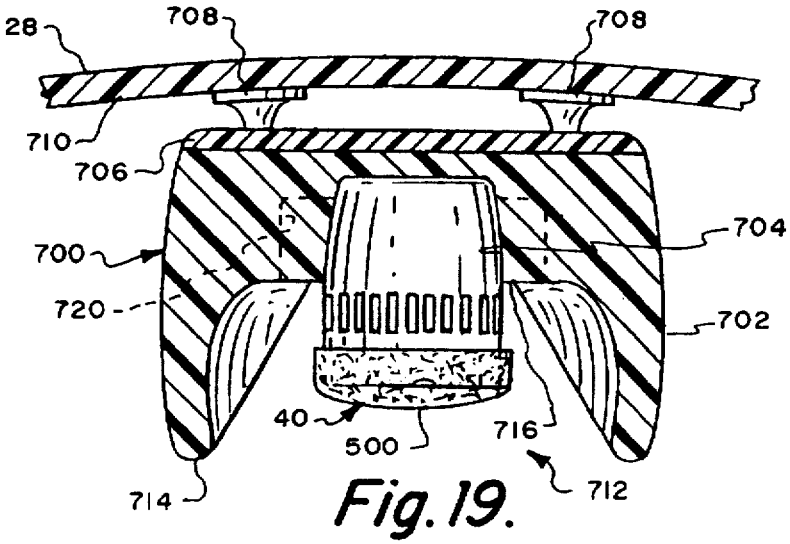
FIG. 19 is a sectional view taken substantially along the plane 19—19 of FIG. 18.
Figures 20, 21:
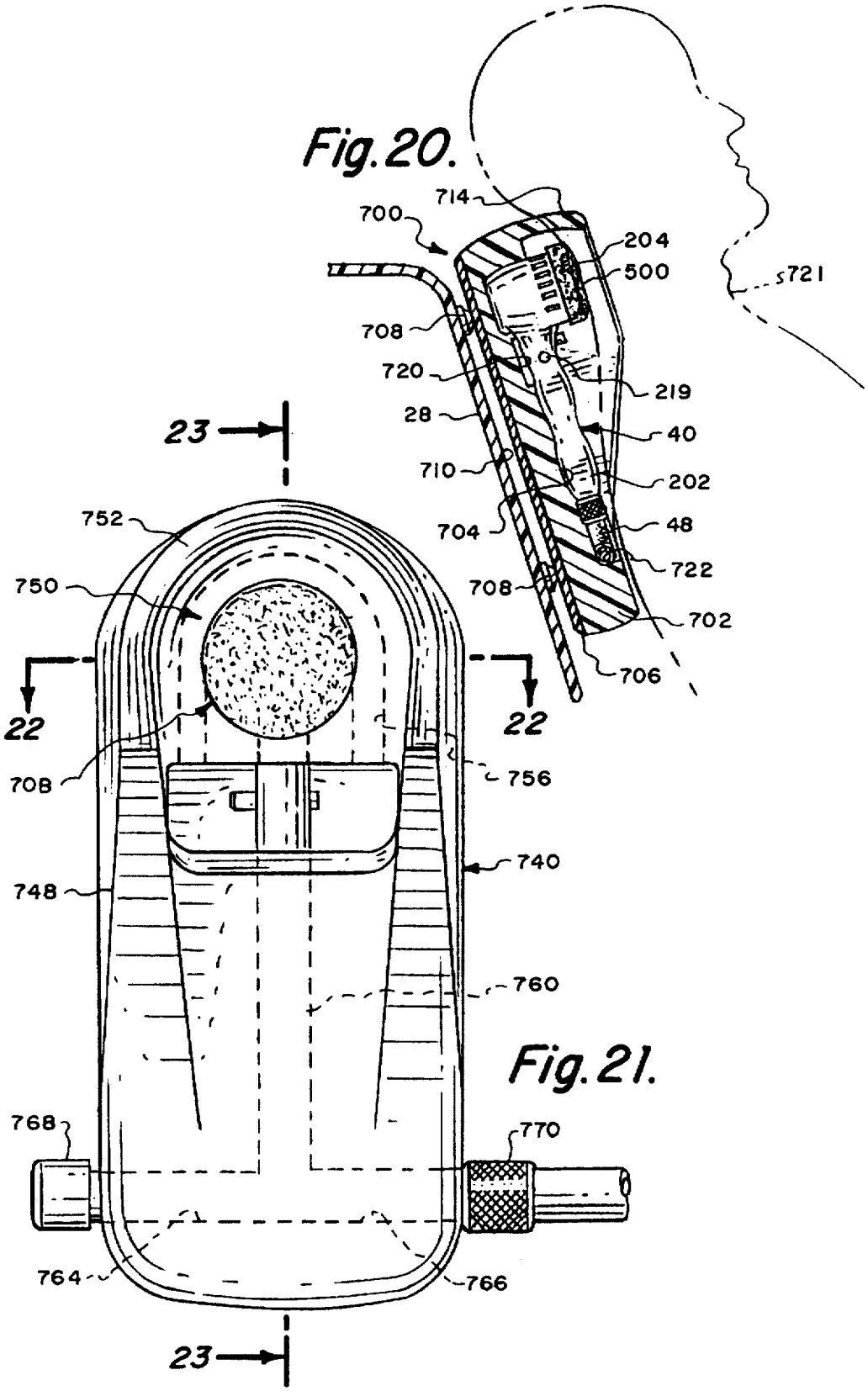
FIG. 20 is a sectional view taken substantially along the plane 20—20 of FIG. 18.
FIG. 21 is a front elevational view of an alternative mounting structure adapted to be detachably secured to a bathtub wall and incorporating a water discharge apparatus.

Attention is now directed to FIGS. 18–20 which illustrate a mounting structure 700 suitable for accommodating the hand held unit 40 and permitting it to function as a wall mounted unit for neck massage. More specifically, the mounting structure 700 is comprised of a flexible and resilient block 702, e.g., formed of foam rubber, defining a pocket 704 for releasably accommodating the hand held unit 40. The block 702 is securely mounted on a rigid backing panel 706. Fasteners such as suction cups 708 are secured to the panel 706 for detachably mounting the structure 700 to the inner surface 710 of bathtub wall 28.

The block 702 is preferably molded to define a large recess 712 surrounded by a peripheral lip 714. The pocket 704 for accommodating the hand held unit 40 extends rearwardly from the back wall 716 of the recess 712. An opening 720 is defined to provide user access to flow control valve 219. Recessed channels 722 and 724 extend in either direction from the pocket 704 for accommodating the supply hose 48 coupled to the handle portion 202.

In use, a user 721 will fasten the mounting structure 700 to the surface 710 of wall 28 via the suction cups 708. The hand held unit 40 will then be pushed into the pocket 704 which conforms to the profile of the handle portion 202 and head portion 204. This will locate the control valve 219 within the access opening 720. The hose 48 can then be pushed into either channel 722 or 724. With the unit 40 so accommodated, the front face of the water permeable membrane structure 500 will be located slightly to the rear of the front edge of lip 714. The user can then lean back against the lip 714, which bends readily, enabling the user to locate his neck against the front face of the membrane structure 500. The lip 714 will essentially seal against the user's skin but the water flow out of the unit 40 can readily exit into the tub via the recess 712.

FIGS. 21–23

Figure 22:
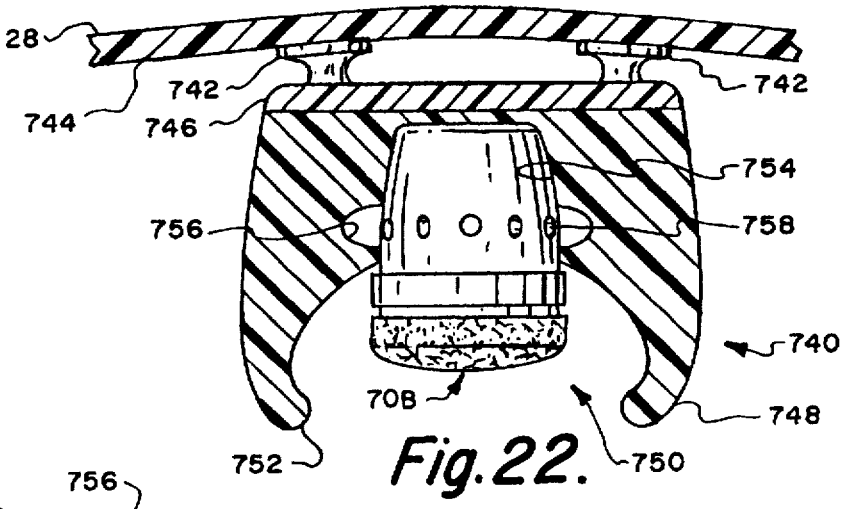
FIG. 22 is a sectional view taken substantially along the plane 22—22 of FIG. 21.
Figure 23:
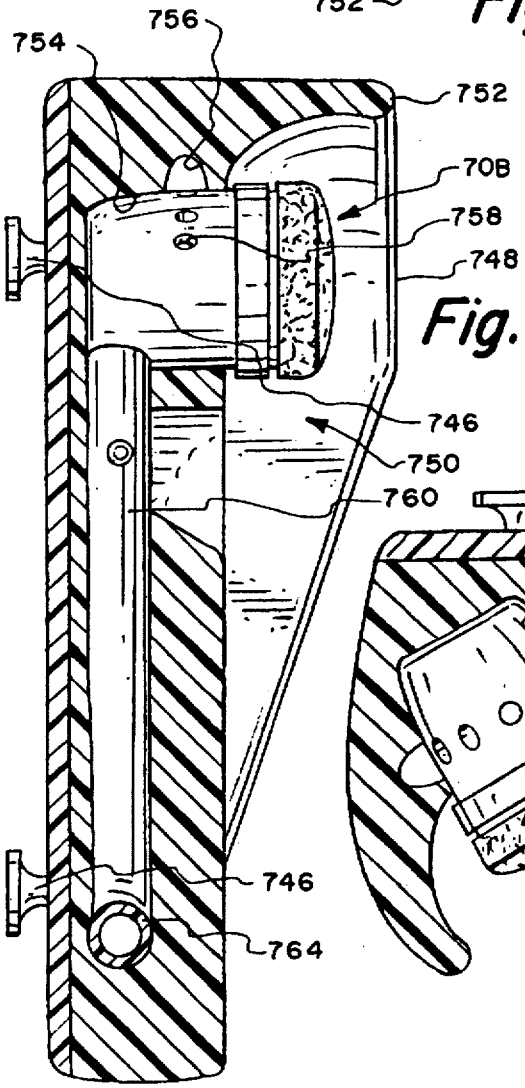
FIG. 23 is a sectional view taken substantially along the plane 23—23 of FIG. 21.

Attention is now called to FIGS. 21–23 which illustrate a further embodiment 740 of the invention, intended to be mounted by a suitable fastener, e.g., suction cups 742, on the surface 744 of bathtub wall 28. Similar to the apparatus 700 of FIGS. 18–20, the apparatus 740 includes a rigid backing panel 746 and a block 748, preferably of foam rubber, secured thereto. The block 748 defines a recess 750 surrounded by a peripheral lip 752. A pocket 754 extends rearwardly from the recess 750 for accommodating a water discharge unit, substantially identical to the unit 70B depicted in FIGS. 16–18. Note in FIG. 23 that the block 748 is internally shaped to provide an overflow channel 756 adjacent overflow holes 758. As depicted in FIG. 21, a vertical pipe stem 760 is accommodated in the block 748 and is coupled directly to the discharge apparatus 70B. Two horizontal stems 764 and 766 exit from the block 748 on opposite sides thereof, terminating in pipe couplers 768, 770.

FIG. 24

Figure 24:
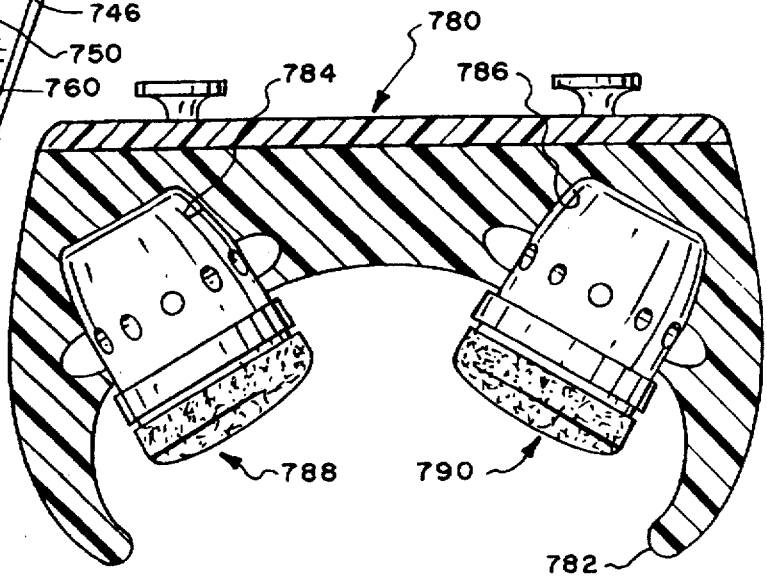
FIG. 24 is a sectional view of a mounting structure similar to that depicted in FIGS. 21–23 except, however, dimensioned to accommodate dual water discharge heads.

FIG. 24 illustrates a further embodiment 780 of the invention, quite similar to the embodiment depicted in FIGS. 21–23, except however that the block 782 is configured with dual pockets 784, 786 for respectively accommodating discharge units 788, 790. As should be apparent, the utilization of two units 788 and 790 within the single mounting structure 780 enables a user to concurrently massage both the left and right side of his neck.

FIGS. 25–29

Figure 25:
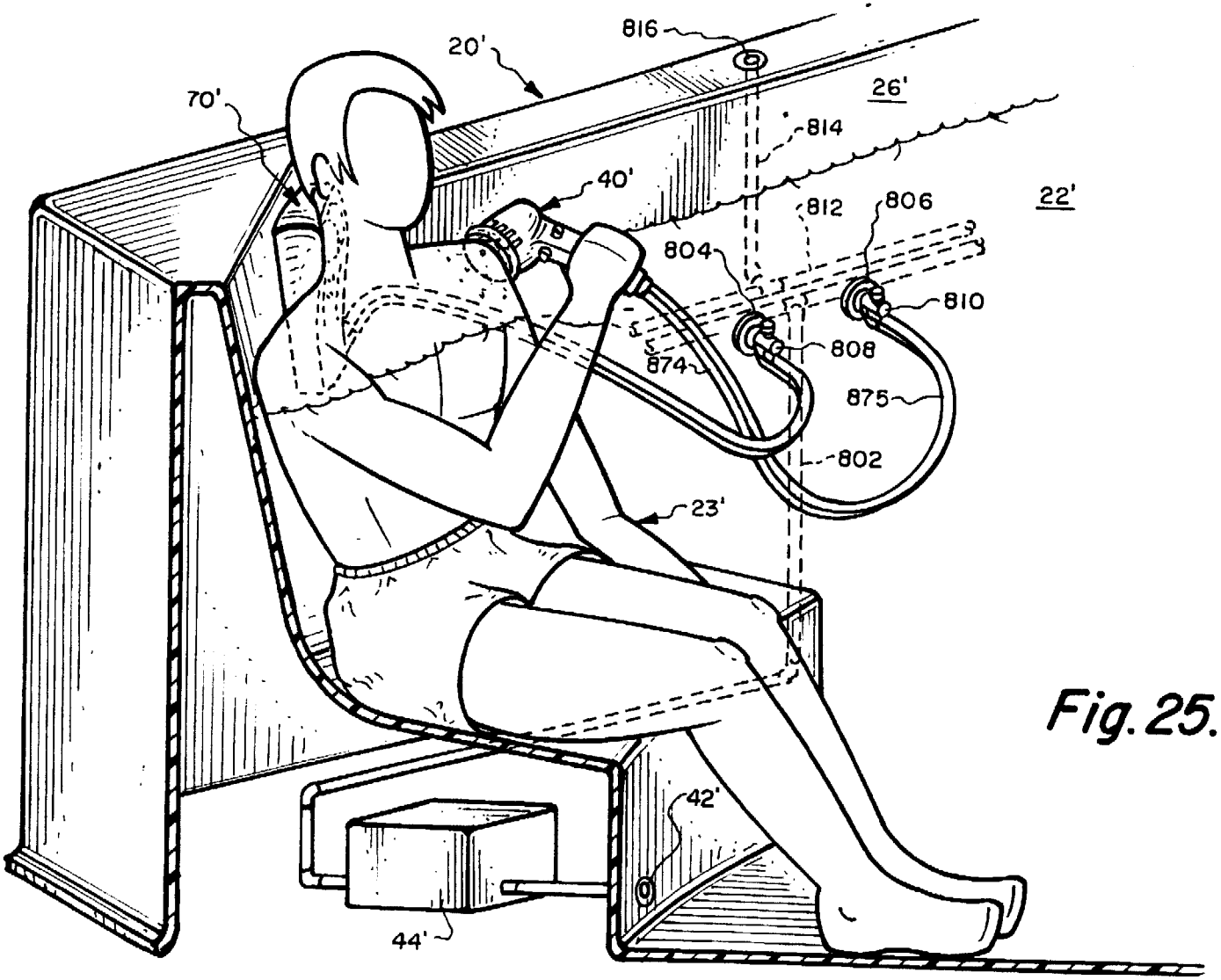
FIG. 25 is an isometric view of a water tub, partially broken away, showing alternative pump powered embodiments of the invention installed therein including a hand held water discharge apparatus and a wall mounted water discharge apparatus.
Figure 26:
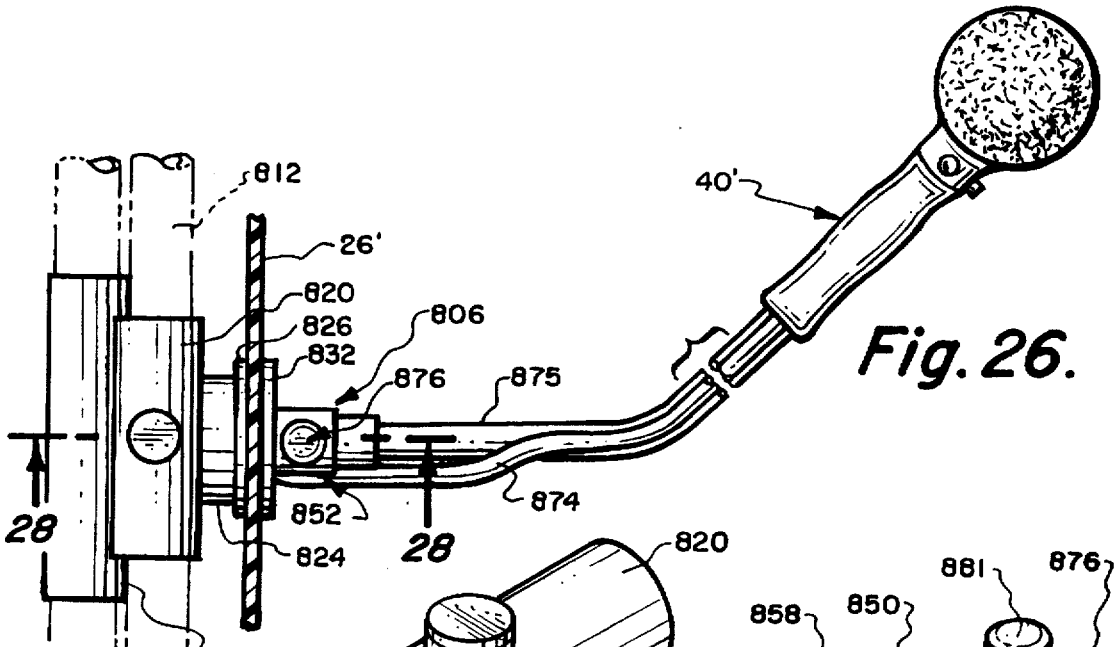
FIG. 26 is a horizontally sectional view taken through the tub wall of FIG. 25 showing the wall fitting and air/water hose coupled to the hand held apparatus.

FIG. 25 depicts an installation similar to FIG. 1 in which a user 23' sits in a water tub 20' having a pump 44' associated therewith for drawing water from pool 22' via water inlet 42'. As shown in FIG. 25, the pump supplied water is distributed via pipe 802 to wall fittings 804 and 806 which are respectively coupled via adapters 808 and 810 to a wall mounted hydromassage unit 70' and a hand held hydromassage unit 40'. As will be seen in greater detail hereinafter, the wall fittings 804, 806 can be of the type conventionally used in spa tubs for discharging a water and air stream. FIG. 25 depicts an air pipe 812 for supplying air to the fittings 804, 806 from pipe 814 which is shown open at its upper end 816.

Figure 27:
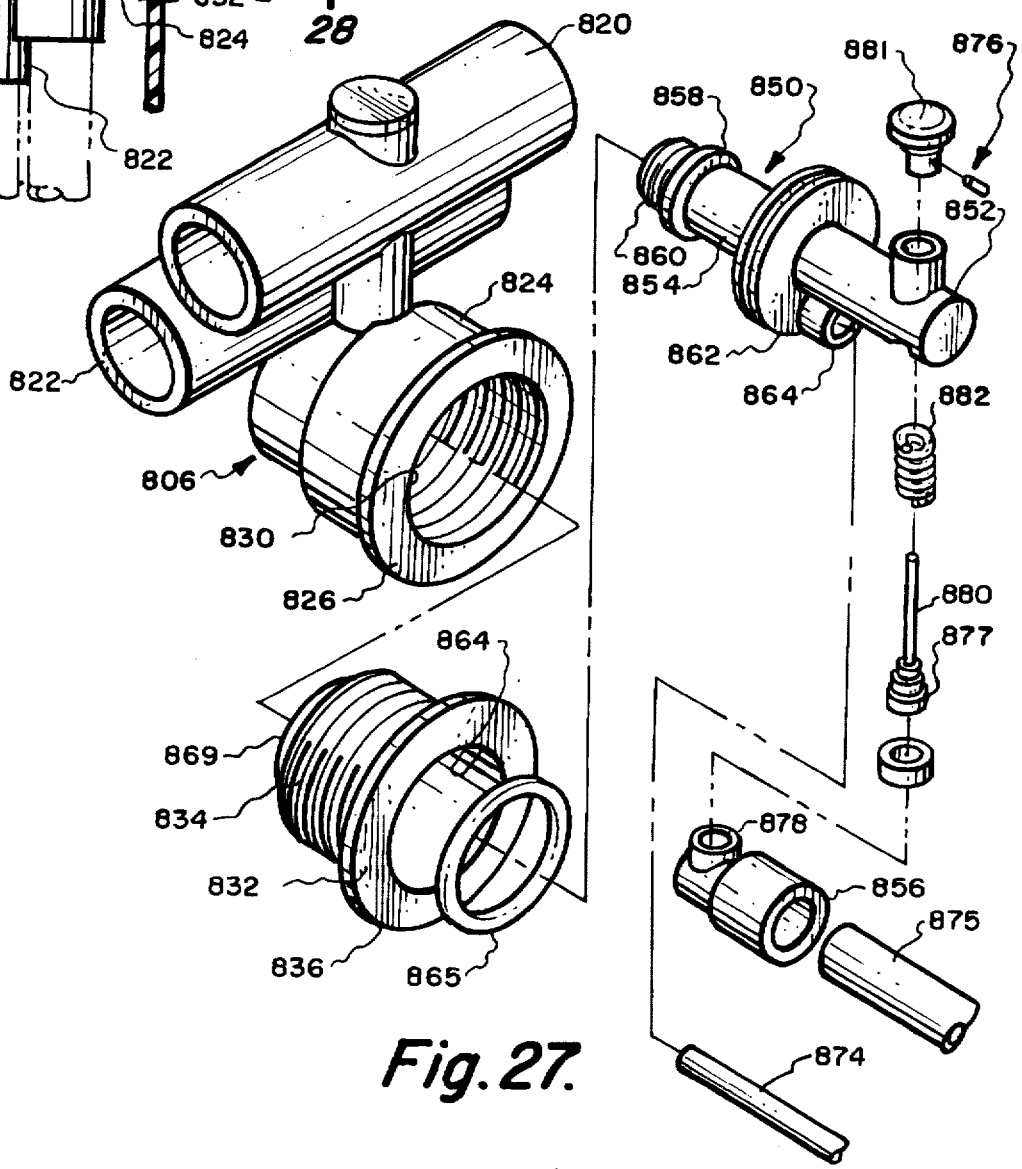
FIG. 27 is an exploded isometric view showing the wall fitting of FIG. 26.
Figure 28:
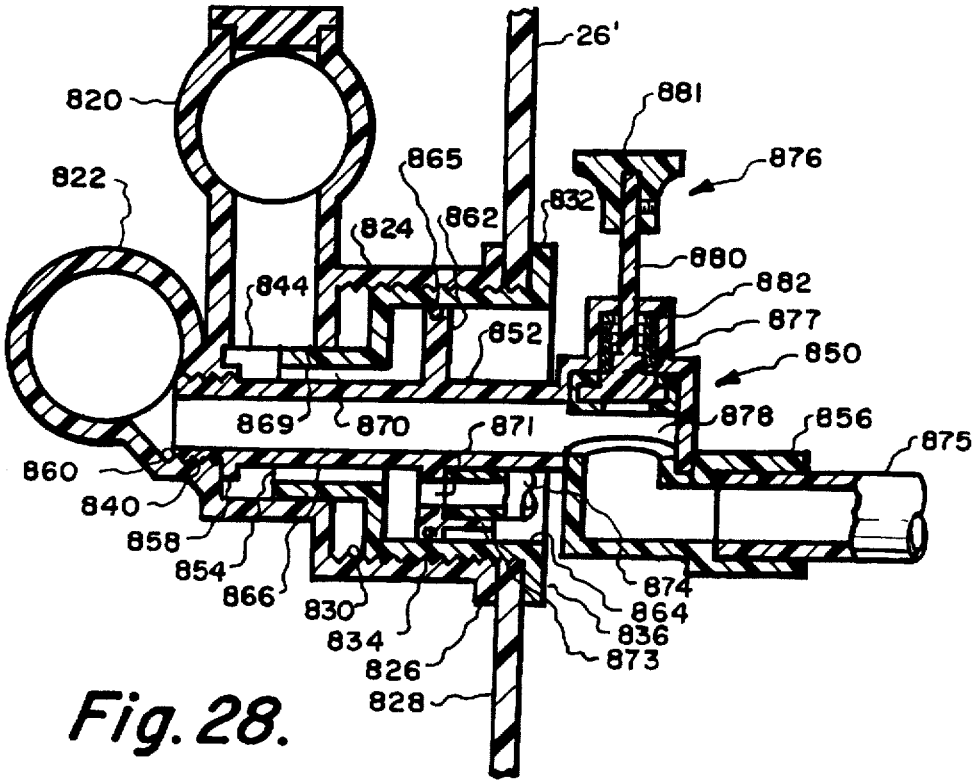
FIG. 28 is a sectional view taken substantially along the plane 28—28 of FIG. 26 showing the automatic shut-off valve in an open position.
Figure 29:
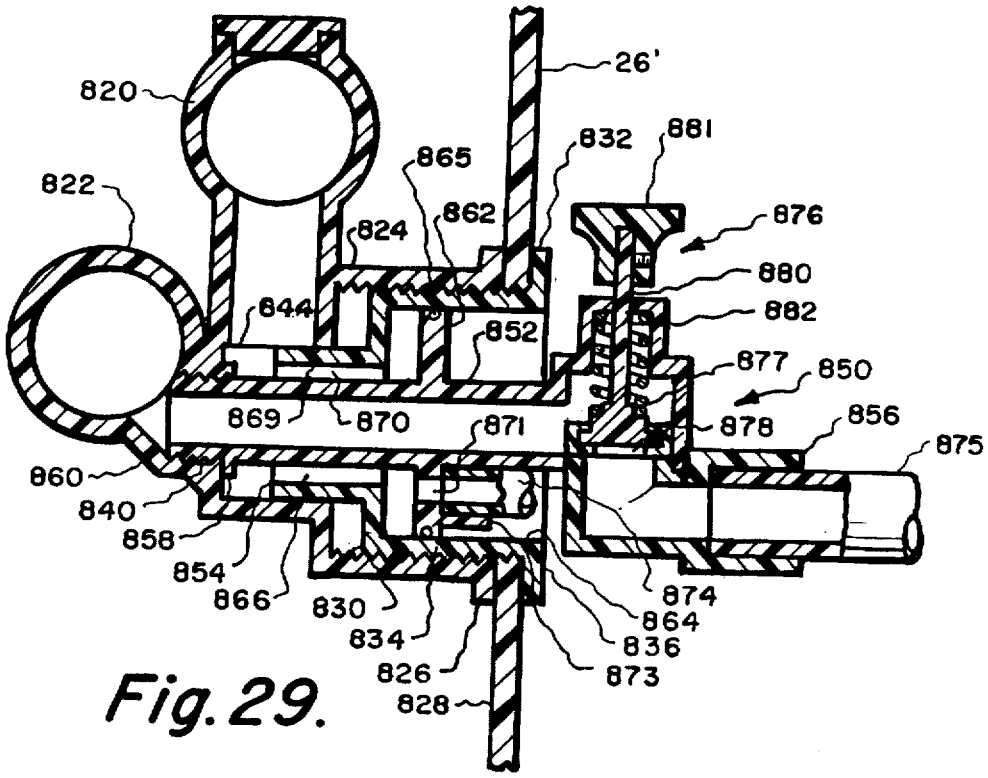
FIG. 29 is a sectional view identical to FIG. 28 but showing the shut-off valve in a closed position.

Attention is now directed to FIGS. 26–29 which illustrate in greater detail a conventional spa wall fitting 806 which is typically mounted on a spa tub inner wall portion 26'. The wall fitting 806 is comprised of pipe sections 820 and 822 oriented parallel to one another. The fitting 806 further includes a cylindrical tubular body 824 whose axis extends essentially perpendicular to those of pipe sections 820, 822. The cylindrical body 824 defines an outwardly extending radial flange 826 intended to engage the rear surface 828 of wall portion 26'. This cylindrical body 824 is internally threaded at 830 for accommodating a mounting member 832 externally threaded at 834. The mounting member 832 is flanged at 836 to mount the fitting on wall portion 26' between flanges 826 and 836 as is best depicted in FIGS. 28 and 29.

The cylindrical body 824 at its rear end opens through internally threaded opening 840 to pipe section 822 which is intended to be coupled to pipe 802 carrying water supplied from pump 44'. The interior of cylindrical body 824, proximate to its rear end, opens radially at 844 to pipe section 820 which is intended to be coupled to air supply pipe 812.

In accordance with the present invention, an adapter 850 is provided for coupling a wall fitting 804, 806 to either a hand held or wall mounted hydromassage apparatus in accordance with the present invention.

The adapter 850 is comprised of an essentially tubular member 852 having a rear portion 854 and a forward portion 856. The rear portion 854 is provided with a positioning flange 858. The tubular member 854 is externally threaded at 860, rearwardly of the positioning flange 858, for threaded accommodation in internally threaded opening 840. A radially extending flange 862 also extends from the tubular member rear portion 854 and is dimensioned to be snugly received against the wall of internal cavity 864 defined in mounting member 832. The flange 862 carries an O-ring 865 which seals against the wall 864. Note, that the diameter of the tubular member rear portion 854 is smaller than the passage 866 extending through the reduced rear portion 869 of the mounting member 832. This creates an annular gap 870 which communicates the air opening 844 to an air hole 871 in the aforementioned flange 862. The air hole 871 communicates with a nipple 873 configured to receive the end of a flexible air hose 874 (FIG. 27). The tubular member rear portion 854 is open at its rear end and provides an open water path from pipe section 822 to forward portion 856 of the tubular member 852. The forward portion 856 is configured to receive the open end of a flexible water hose 875.

In accordance with a significant feature of the adapter 850, a valve 876 is incorporated in the water passage between pipe section 822 and water hose 875 to automatically close the passage when the pump 44' is shut off. When the pump is turned back on, the valve must be manually opened to enable water flow from pipe section 822 to hose 875.

More particularly, the automatic shut-off valve 876 is comprised of a valve element 877 mounted for vertical reciprocal movement between an open position depicted in FIG. 28 and a closed position depicted in FIG. 29. More specifically, when the valve element is in the open position, (FIG. 28), the water passage from pipe section 822 to hose 875 is open. On the other hand, when the valve element 877 is in its closed position (FIG. 29), it engages valve seat 878 to prevent water flow from pipe section 822 to hose 875. A stem 880 connects valve element 877 to a knob 881. A spring 882 mounted around stem 880 biases the valve element 877 to the closed position (FIG. 29). The valve element 877 can be moved to its open position by manually lifting the knob 881 against the spring bias 882. With the pump 44' supplying water to the pipe section 822, the water flow past the valve element 877 and valve seat 878 will hold the valve element in its open position. However, when the pump 44' is turned off, the spring 882 will close the valve element 877. Accordingly, water will not be supplied to the hose 875 when the pump 44' is turned on until the user manually lifts the knob 881 to initiate water flow to the hose 875.

FIGS. 30–37

Attention is now directed to FIGS. 30–37 which collectively illustrate a still further hand held discharge embodiment 900, similar in many respects to the embodiment depicted in FIGS. 4–10, but differing therefrom primarily in that (1) means are provided for mixing air into the massage stream discharged from discharge orifice 902 and (2) a selector valve 904 is incorporated in the unit's head portion 906 between the reduced cross section exit orifice 908 and hydromassage entrance 910 in lieu of the selector slide valve 222 used in the embodiment of FIGS. 4–10.

Figures 30, 31:
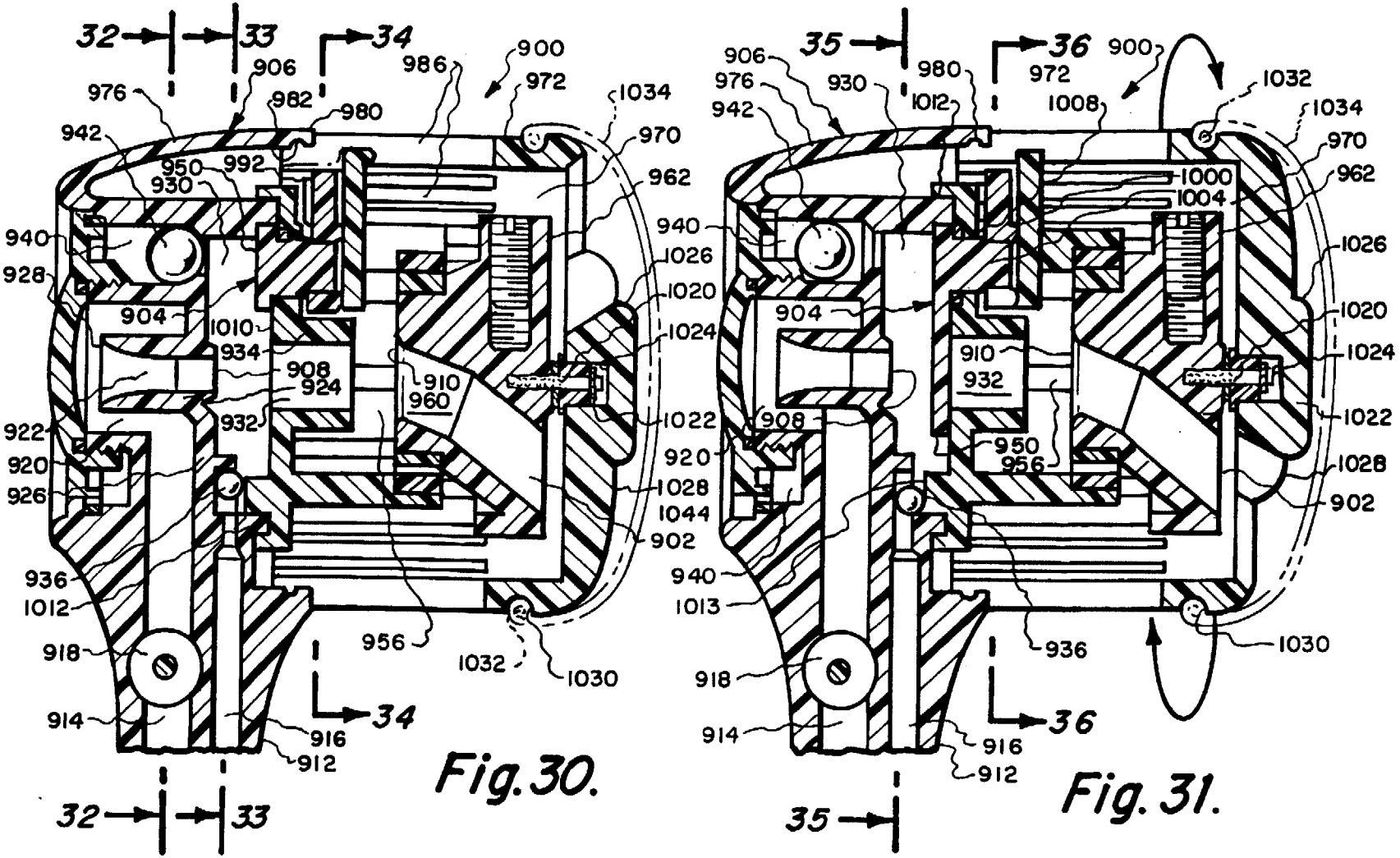
FIG. 30 is a sectional view of an alternative water discharge apparatus configured to entrain air and/or water in the hydromassage mode, the figure depicting operation in the hydromassage mode.
FIG. 31 is a sectional view similar to FIG. 30 except depicting operation in the shower mode.
Figure 32:
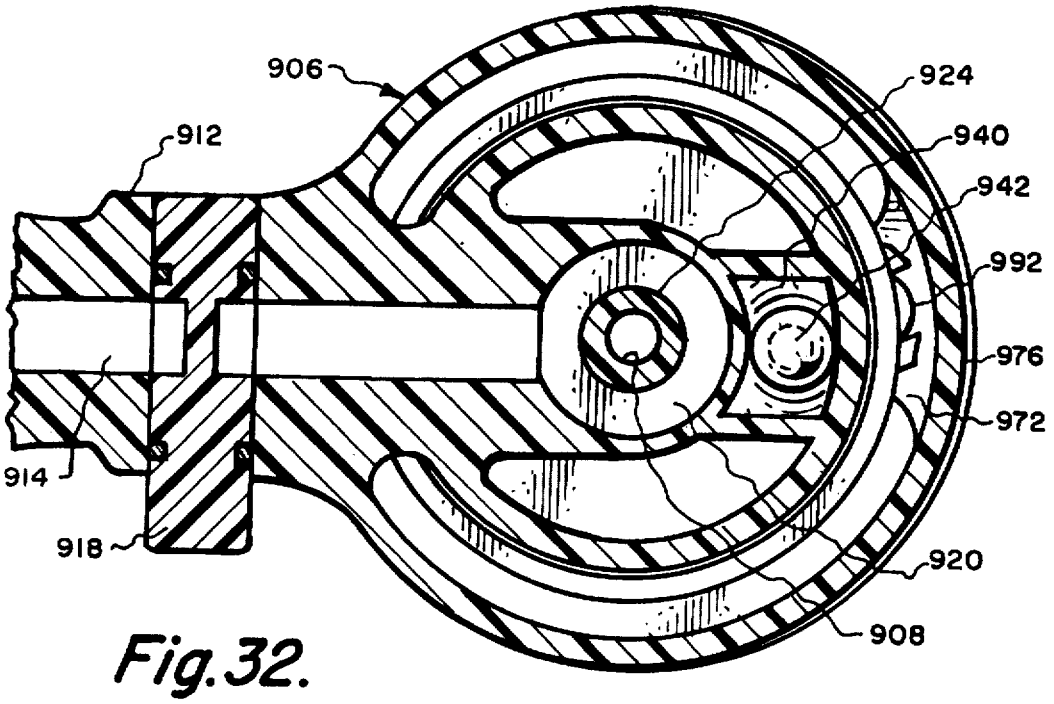
FIG. 32 is a sectional view taken substantially along the plane 32—32 of FIG. 30.

The unit 900 includes a handle portion 912 coupled to the head portion 906. The handle portion 912 includes, in addition to the water supply passageway 914, an air supply passageway 916. The water supply passageway 914 includes a slide control valve 918, substantially identical to the valve 219 discussed in the embodiment of FIGS. 4–10. Supply water flowing past the valve 918 enters chamber 920. The only outlet from chamber 920 is defined by passageway 922 formed in boss 924 extending axially through wall 926. The passageway 922 converges from a wider entrance 928 to the aforementioned reduced cross section exit orifice 908. The exit orifice 908 opens into a second chamber 930. As shown in FIG. 30, the exit orifice 908 is aligned with a short passageway 932 formed in nipple 934. The air passageway 916 also communicates with the chamber 930 via a check valve 936 which is depicted in the open (unseated) position in FIG. 30. The check valve 936 is depicted as closed (seated) in FIG. 31. The chamber 930 also communicates with a shower manifold 940 via a check valve 942. Check valve 942 is depicted as closed (seated) in FIG. 30. Check valve 942 is depicted as open (unseated) in FIG. 31. When the unit 900 is operated in the shower mode, shower check valve 942 is open and air check valve 936 is closed. When operating in the hydromassage mode, air check valve 936 is open and shower check valve 942 is closed.

Figure 33:
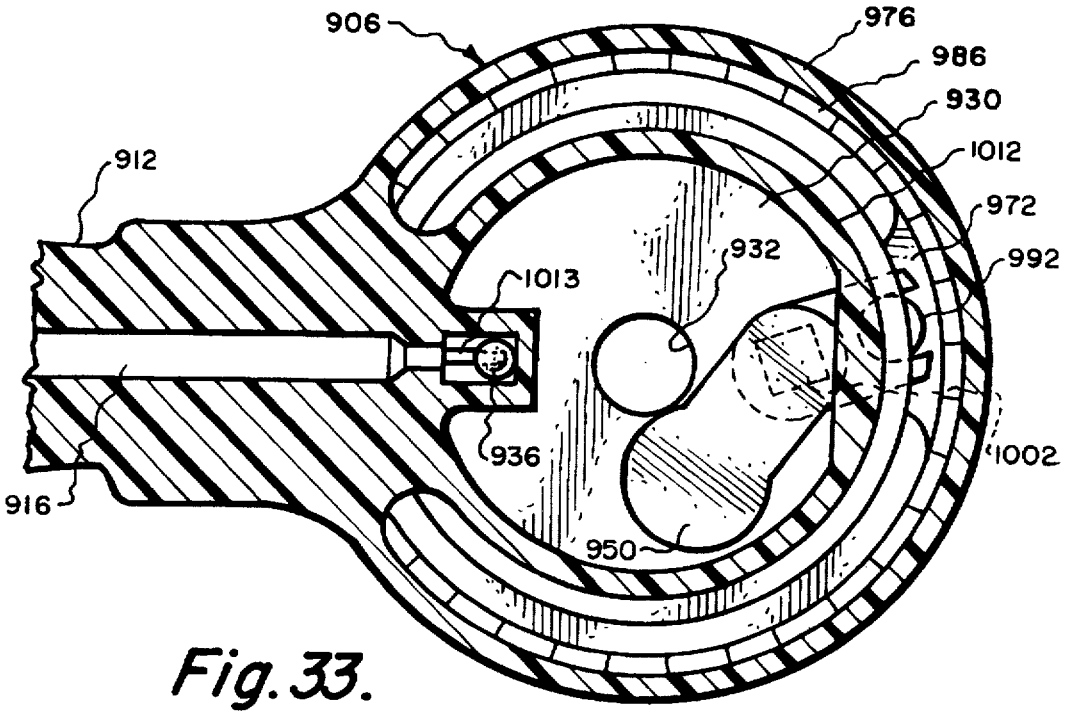
FIG. 33 is a sectional view taken substantially along the plane 33—33 of FIG. 30.
Figure 35:
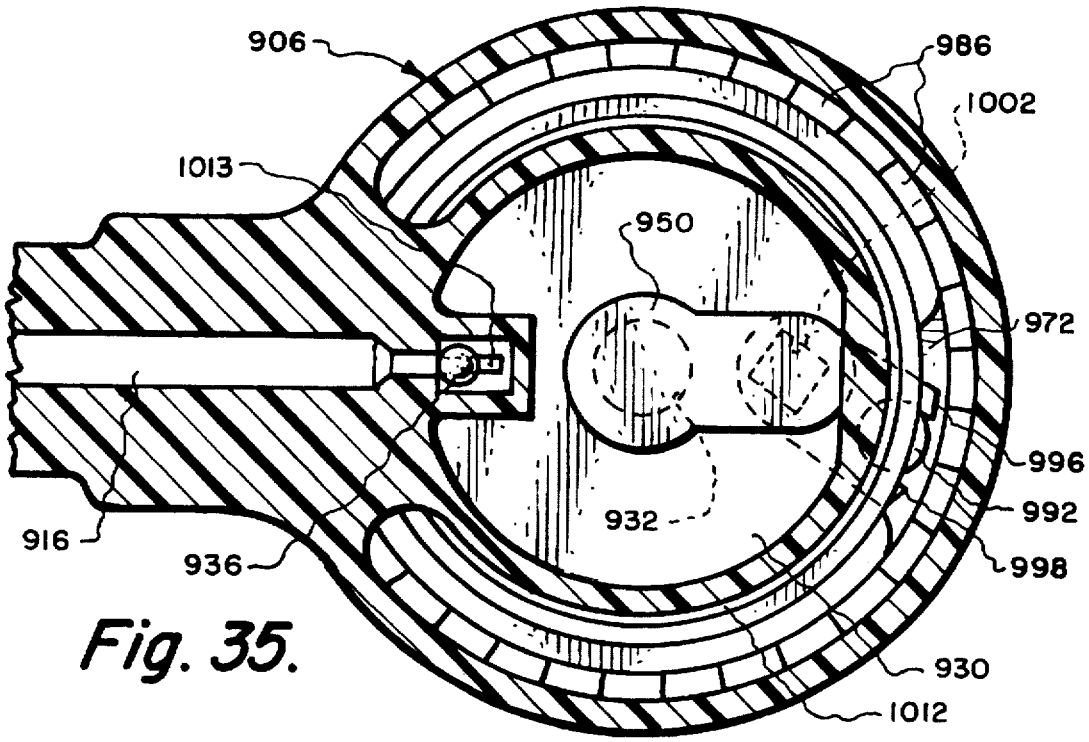
FIG. 35 is a sectional view taken substantially along the plane 35—35 of FIG. 31.

The aforementioned selector valve 904 is comprised of a selector valve element 950 mounted for movement between the hydromassage mode position depicted in FIG. 33 and the shower mode position depicted in FIG. 35. When in the hydromassage mode position, (FIG. 33) the reduced cross section exit orifice 908 communicates directly with the passageway 932 to discharge a high velocity flow through cavity 956 into the entrance 910 of hydromassage passageway 960 formed in hydromassage member 962. The high velocity water flow from exit orifice 908 produces a negative pressure in chamber 930 which opens check valve 936 as depicted in FIG. 30 to draw air via passageway 916, and entrain the air with the water flow as it enters passageway 932. The high velocity water air stream entering the hydromassage passageway entrance 910 can then entrain water in the cavity 956 when the unit is being operated below tub water level.

Figure 37:
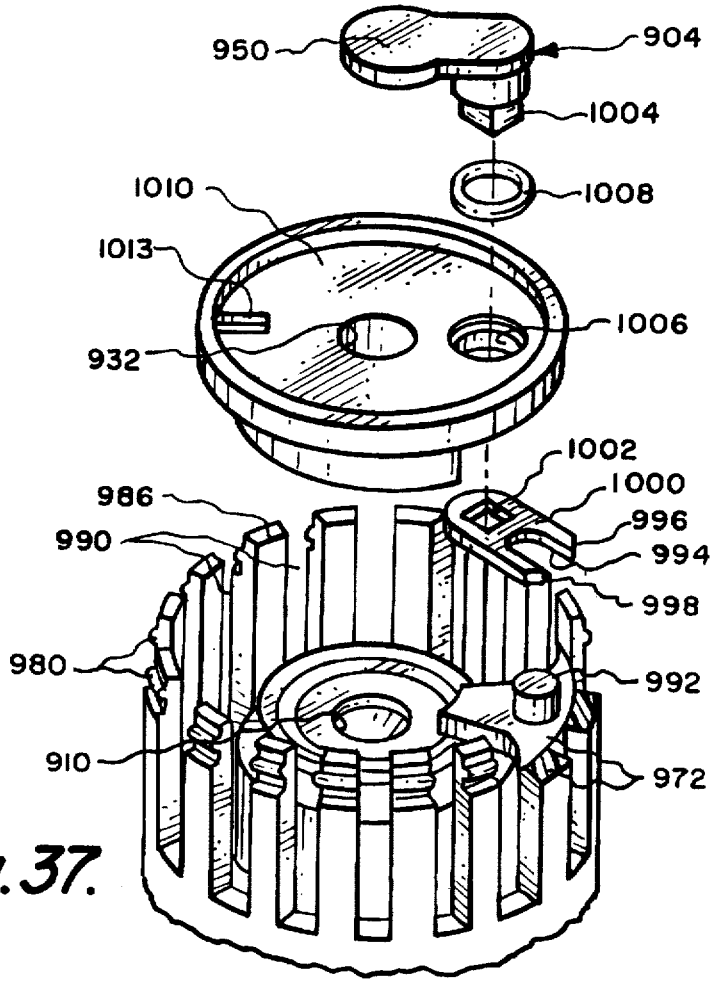
FIG. 37 is an isometric view illustrating the selector valve used in the embodiment depicted in FIGS. 30–36 for selecting either the shower mode or hydromassage mode.

The head portion 906 is formed by a forward cup-shaped housing portion 972 mounted for axial rotation relative to a rearward housing portion 976. The two housing portions are coupled for rotation at annular bead 980 formed on housing portion 972 which rotates in annular recess 982 formed in housing portion 976. The bead 980 in actuality is formed along a series of annularly arranged fingers 986 formed on the housing portion 972, as is best seen in FIG. 37. The fingers 986 are spaced by slots 990 which permit water to drain from the cavity 956.

Figure 34:
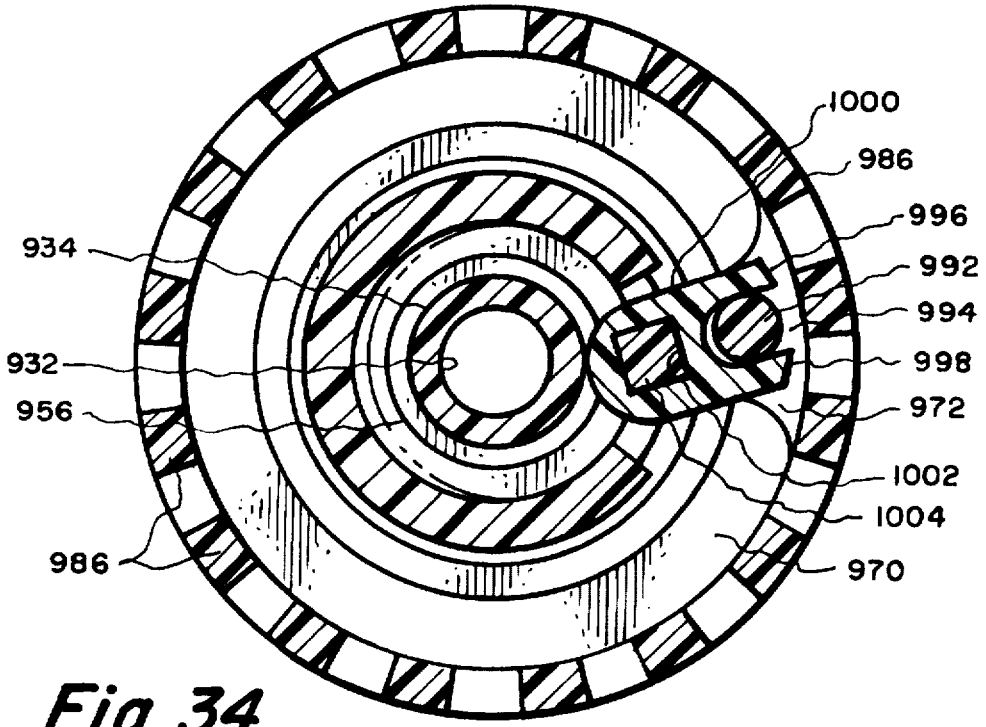
FIG. 34 is a sectional view taken substantially along the plane 34—34 of FIG. 30.
Figure 36:
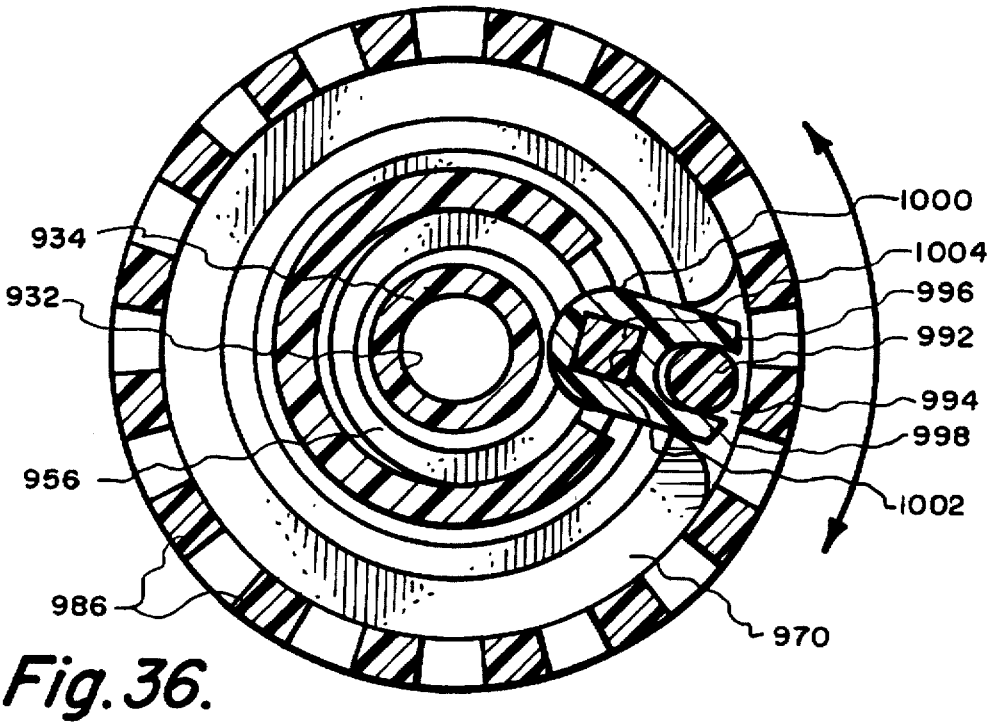
FIG. 36 is a sectional view taken substantially along the plane 36—36 of FIG. 31.

The valve element 950 is moved between the shower mode and hydromassage mode positions respectively depicted in FIGS. 35 and 33 as a consequence of relative rotation between the housing portions 972 and 976. More specifically, housing portion 972 carries a fixed stud 992 adjacent its periphery (FIGS. 34, 36). The stud extends into a recess 994 between legs 996 and 998 of a U-shaped valve actuator 1000. The actuator 1000 defines a square opening 1002 dimensioned to receive a square shaft 1004 which extends perpendicularly from the aforementioned valve element 950. As is best seen in FIG. 37, the square shaft 1004 extends through a circular opening 1006, sealed by O-ring 1008, in disc-shaped element 1010. Element 1010 defines the aforementioned axial passageway 932. Disc element 1010 is fixed in position relative to housing portion 976, as by gluing at 1012. Radial ridge 1013 functions to guide air check valve element 936.

Thus, with the position of opening 1006 fixed, rotation of the housing portion 972 will move the stud between the positions represented in FIG. 34 and 36. This of course will cause the valve actuator 1000 to assume either the position depicted in FIG. 34 or the position depicted in FIG. 36. The valve actuator position depicted in FIG. 34 will move the valve element 950 to the hydromassage position as shown in FIG. 33. The valve actuator position depicted in FIG. 36 will move the valve element 950 to the shower mode position depicted in FIG. 31.

In the operation of the unit 900, first assume that the flow control valve 918 is open and that the selector valve 904 is in the hydromassage position represented in FIGS. 30, 33, and 34. In this position, the high velocity flow from the exit orifice 908 will discharge through chamber 930 and passageway 932 and then through cavity 956 into the hydromassage passageway 960. The negative pressure produced in chamber 930 by the high velocity discharge will close the shower check valve 942 and open the air check valve 936. Consequently, air will be drawn from passageway 916 and will be entrained by the high velocity flow. Upon emerging from the passageway 932, this high velocity water/air stream enters the entrance 910 to hydromassage passageway 960. If the unit 900 is being operated submerged, i.e., below tub water level, then the cavity 956 will be flooded by tub water and the high velocity stream will entrain additional water from the cavity as it enters the hydromassage passageway 960. If on the other hand the unit 900 is being operated out of the water, then the high velocity stream will enter the hydromassage passageway 960 without water entrainment. In either case, the discharge from the discharge orifice 902 will produce a tangential force to rotate the member 960 about the axis defined by pin 1020. As previously discussed in connection with the embodiment depicted in FIGS. 4–10, pin 1020 is mounted for rotation in bearing 1022 supported in recess 1024 in the hub 1026 of the front frame portion 1028 of the housing portion 972. As has been previously discussed, the frame portion 1028 is provided with an annular recess 1030 intended to accommodate the elastic peripheral member 1032 of a water permeable membrane structure 1034.

When the housing portion 972 is rotated to move the valve actuator 1000 and valve element 950 to the positions depicted in FIGS. 31, 35, and 36, the entrance to passageway 932 will be blocked. Consequently, the water flow issuing from exit orifice 908 will accumulate and produce a positive pressure in chamber 930 to thus close air check valve 936 and open shower check valve 942. The water will thus flow from chamber 930 into the shower manifold 940 from which it exits through the shower outlets defined by radial slits 1044, in the manner previously described in connection with the embodiment of FIGS. 4–10.

From the foregoing, it should now be clear that various hand held and wall mounted embodiments have been disclosed capable of responding to pump supplied recirculated tub water for discharging a water stream against the rear face of a water permeable membrane configured to allow the membrane front face to engage a user's body. Embodiments of the invention may include either a travelling or fixedly mounted discharge orifice and can be configured to entrain water and/or air.

Although specific preferred embodiments have been described herein, it is recognized that various structural modifications and equivalents will occur to those skilled in the art and it is expressly intended that such be encompassed within the scope of the appended claims.

We claim:

1. Hydromassage apparatus useful in combination with a water tub and an electric pump source supplying water drawn from a pool in said tub, said apparatus comprising:

a water supply port configured for coupling to said pump source;

a hydromassage passageway defining an entrance orifice and a discharge orifice for discharging a hydromassage stream therefrom;

a nozzle means responsive to a supplied water flow from said pump source for providing a high velocity water flow to said entrance orifice;

a flexible water permeable cloth membrane having front and rear faces, said membrane mounted proximate to said discharge orifice with said rear face oriented to be impacted by said hydromassage stream and said front face oriented to engage a user's body to allow said stream to pass through said membrane and impact against said user's body; and means for supplying water proximate to said entrance orifice for entrainment by said high velocity water flow.

2. Hydromassage apparatus useful in combination with a water tub and an electric pump source supplying water drawn from a pool in said tub, said apparatus comprising:

a water supply port configured for coupling to said pump source;

a hydromassage passageway defining an entrance orifice and a discharge orifice for discharging a hydromassage stream therefrom;

a nozzle means responsive to a supplied water flow from said pump source for providing a high velocity water flow to said entrance orifice;

a flexible water permeable cloth membrane having front and rear faces, said membrane mounted proximate to said discharge orifice with said rear face oriented to be impacted by said hydromassage stream and said front face oriented to engage a user's body to allow said stream to pass through said membrane and impact against said user's body; and means for supplying air proximate to said entrance orifice for entrainment by said high velocity water flow.

3. Hydromassage apparatus useful in combination with a water tub and an electric pump source supplying water drawn from a pool in said tub, said apparatus comprising:

a water supply port configured for coupling to said pump source;

a hydromassage passageway defining an entrance orifice and a discharge orifice for discharging a hydromassage stream therefrom;

a nozzle means responsive to a supplied water flow from said pump source for providing a high velocity water flow to said entrance orifice;

a flexible water permeable cloth membrane having front and rear faces, said membrane mounted proximate to said discharge orifice with said rear face oriented to be impacted by said hydromassage stream and said front face oriented to engage a user's body to allow said stream to pass through said membrane and impact against said user's body; and a housing defining a cavity proximate to said entrance orifice for supplying water for entrainment by said high velocity water flow; and at least one outflow hole in said housing for permitting water to exit from said cavity.

4. The apparatus of claim 3 wherein said outflow hole comprises a drain hole positioned in said housing to drain water from said cavity when said apparatus is oriented for normal operation.

5. The apparatus of claim 4 further including at least one overflow hole communicating with said cavity.

6. Hydromassage apparatus useful in combination with a water tub and an electric pump source supplying water drawn from a pool in said tub, said apparatus comprising:

a water supply port configured for coupling to said pump source;

a discharge orifice coupled to said supply port for discharging a hydromassage stream therefrom;

a flexible water permeable cloth membrane having front and rear surfaces, said membrane mounted proximate to said discharge orifice with said rear surface oriented to be impacted by said hydromassage stream and said front surface oriented to engage a user's body to allow said stream to pass through said membrane and impact against said user's body;

a housing defined a front face and a rear face;

means supporting said discharge orifice in said housing for discharging said hydromassage stream through said housing front face;

said membrane extending across said housing front face;

at least one shower outlet supported in said housing oriented to discharge a shower spray through said rear face; and valve means for selectively coupling said supply port to either said discharge orifice or said shower outlet.

7. Apparatus useful in combination with a water tub having a pump source for supplying water drawn from a water pool in said tub, said apparatus comprising:

a housing having a water supply entrance and a water supply exit, said water supply entrance adapted to be coupled to said pump source;

a hydromassage member having an entrance orifice communicating with said water supply exit and a discharge orifice for discharging a hydromassage stream;

a flexible water permeable cloth membrane having front and rear surfaces said membrane mounted on said housing proximate to said discharge orifice oriented to enable said rear surface to be impacted by said hydromassage stream and said membrane front surface to engage a user's body to allow said stream to pass through said membrane and impact against said user's body; and a reduced cross section orifice responsive to water supplied by said pump source for introducing a high velocity water flow into said entrance orifice.

8. The apparatus of claim 7 including means for supplying water proximate to said entrance orifice for entrainment by said high velocity water flow.

9. The apparatus of claim 7 including means for supplying air proximate to said entrance orifice for entrainment by said high velocity water flow.

10. The apparatus of claim 7 wherein said housing defines an open first face; and wherein said discharge orifice is supported in said housing oriented to discharge said hydromassage stream through said first face.

11. The apparatus of claim 10 wherein said means mounting said membrane includes an open frame extending across said housing first face; and a peripheral elastic member secured to said membrane for releasably securing said membrane to said frame.

12. The apparatus of claim 7 wherein said reduced cross section orifice and said entrance orifice are aligned along a common axis; and wherein said hydromassage member is supported for rotation substantially about said common axis.

13. The apparatus of claim 12 further including weight means eccentrically carried by said hydromassage member for enhancing the massaging of said protuberance means.

14. The apparatus of claim 7 wherein said housing defines an internal cavity and said reduced cross section orifice and said entrance orifice are both open to said cavity; and means substantially aligning said reduced cross section orifice and said entrance orifice for enabling said high velocity supply water flow to entrain water from said cavity proximate to said entrance orifice for flow through said hydromassage member to said discharge orifice.

15. The apparatus of claim 14 including at least one drain hole in said housing communicating with said cavity.

16. The apparatus of claim 14 including at least one overflow hole communicating with said cavity.

17. Apparatus useful in combination with a water tub having a pump source for supplying water drawn from a water pool in said tub, said apparatus comprising:

a housing having a water supply entrance and a water supply exit, said water supply entrance adapted to be coupled to said pump source;

a hydromassage member having an entrance orifice communicating with said water supply exit and a discharge orifice for discharging a hydromassage stream;

a flexible water permeable cloth membrane having front and rear surfaces said membrane mounted on said housing proximate to said discharge orifice oriented to enable said rear surface to be impacted by said hydromassage stream and said membrane front surface to engage a user's body to allow said stream to pass through said membrane and impact against said user's body; and a shower passageway having a shower entrance port and at least one shower outlet; and user operable valve means for selectively communicating said supply exit to either said shower entrance port or said hydromassage member entrance orifice.

18. The apparatus of claim 17 wherein said housing defines differently oriented first and second external faces; and wherein said hydromassage member discharge orifice is oriented to discharge said hydromassage stream through said first external face and said shower passageway shower outlets are oriented to discharge a shower spray through said second external face.

* * * * *